US012595725B2

(12) United States Patent
Song et al.

(10) Patent No.: US 12,595,725 B2
(45) Date of Patent: Apr. 7, 2026

(54) OIL DISPLACEMENT METHOD FOR AN ULTRA-HIGH WATER-CUT RESERVOIR

(71) Applicant: CHINA UNIVERSITY OF PETROLEUM-BEIJING, Beijing (CN)

(72) Inventors: Kaoping Song, Beijing (CN); Bingyu Ji, Beijing (CN); Hongtao Fu, Beijing (CN); Zhaojie Song, Beijing (CN)

(73) Assignee: CHINA UNIVERSITY OF PETROLEUM-BEIJING, Beijing (CN)

( * ) Notice: Subject to any disclaimer, the term of this patent is extended or adjusted under 35 U.S.C. 154(b) by 0 days.

(21) Appl. No.: 18/897,603

(22) Filed: Sep. 26, 2024

(65) Prior Publication Data

US 2026/0015925 A1 Jan. 15, 2026

(30) Foreign Application Priority Data

Jul. 12, 2024 (CN) ..... 202410939720.8

(51) Int. Cl.
*E21B 43/16* (2006.01)
*E21B 43/20* (2006.01)

(52) U.S. Cl.
CPC ..... *E21B 43/164* (2013.01); *E21B 43/20* (2013.01)

(58) Field of Classification Search
CPC ..... E21B 43/16; E21B 43/162; E21B 43/166; E21B 43/168; E21B 43/20; C09K 8/58; C09K 8/588; C09K 8/594
See application file for complete search history.

(56) References Cited

U.S. PATENT DOCUMENTS 4,856,588 A * 8/1989 Borchardt ..... C09K 8/584 166/275
2015/0345268 A1* 12/2015 Bryant ..... C09K 8/62 507/202
2022/0412197 A1* 12/2022 AlYousef ..... E21B 43/164

FOREIGN PATENT DOCUMENTS

CA 1129634 A 8/1982
CN 106639976 A 5/2017
(Continued)

OTHER PUBLICATIONS

Translation of CN-115680581-A (Year: 2023).*
(Continued)

*Primary Examiner* — Angela M DiTrani Leff
(74) *Attorney, Agent, or Firm* — Jacob M. Ward; Ward Law Office LLC

(57) ABSTRACT

An oil displacement method for an ultra-high water-cut reservoir, including the following steps: injecting water into the reservoir to carry out a water flooding until water cut of the reservoir is greater than 90%; injecting a polymer solution and a supercritical carbon dioxide oil displacement agent, respectively; injecting water to carry out water flooding after injection of the polymer solution or the supercritical carbon dioxide oil displacement agent is completed; where injection amounts of both the polymer solution and the supercritical carbon dioxide oil displacement agent are not less than 0.1 PV, and a total injection amount of the polymer solution and the supercritical carbon dioxide oil displacement agent is 0.3-1.2 PV; and a viscosity ratio of the polymer solution to a crude oil in the reservoir is 1:(0.8-10), and a viscosity ratio of the supercritical carbon dioxide oil displacement agent to the crude oil in the reservoir is 1:(10-800).

20 Claims, 8 Drawing Sheets

(56) References Cited

FOREIGN PATENT DOCUMENTS

| | | | | | |
|---|---|---|---|---|---|
| CN | 108729893 | A | | 11/2018 | |
| CN | 111849449 | A | * | 10/2020 | ..... C09K 8/594 |
| CN | 115478817 | A | * | 12/2022 | ..... E21B 43/164 |
| CN | 115680581 | A | * | 2/2023 | |
| CN | 117307120 | A | | 12/2023 | |
| WO | 2015135855 | A1 | | 9/2015 | |

OTHER PUBLICATIONS

Translation of CN-111849449-A (Year: 2020).*

Translation of CN 115478817 A (Year: 2022).*

Danbiao, Xu and Weihong, Liu, "Application of Polymer in the Production of Shanchuan Gas Field", Application of Polymer in Oil and Gas Field Exploitation/Xu Mingbiao, Liu Jiu: Editor.—Wuhan: China University of Geosciences Press, 2010. | 1S80i 978-7-5625-24: > 8-8, CIP Data of Chinese Library Edition Hening (2010) No. 032753, ISBN 978-7-5625-2458-8.

Wanchao, Song, "Technology and method of oil field development in high water cut stage", Development Techniques and Methods/Song Wanchao in High Water Cut Stage, Beijing: The Quality Press, 2003.3 T S BN 7-116-03 768-3.

Leap Lifeng Pupu, "Green Chemistry", University of Science and Technology of China graduate teaching materials, Green chemical studies/edited by leap peaks. Hefei: China Science and Technology University Press, 2007, Book 1, China, University of Science and Technology of China research cattle textbook, ISBN 978-7-312-02022-3.

He Qingong Gu Dizhi et al., "Polymer materials for oilfield development", Published by Petroleum Industry Press, Oct. 1990, Beijing 1st edition.

Song, W., and Li, Y., "Experimental Study on Polymer Flooding in Shengli Oil Field." Journal—University of Petroleum China Natural Science Edition 24, No. 5; 2000, pp. 52-54, Article ID: 1000-5870(2000) 05-0052-03.

* cited by examiner

OIL DISPLACEMENT METHOD FOR AN ULTRA-HIGH WATER-CUT RESERVOIR

CROSS-REFERENCE TO RELATED APPLICATION

The present application claims priority to Chinese Patent Application No. 202410939720.8, filed on Jul. 12, 2024, which is incorporated by reference in its entirety.

TECHNICAL FIELD

The present disclosure relates to the technical field of petroleum and natural gas engineering, and in particular, to an oil displacement method for an ultra-high water-cut reservoir.

BACKGROUND

China's oil and gas fields are mainly distributed in continental sedimentary basins, with characteristics of high viscosity and high wax content. After continuous water flooding, eastern sandstone oilfields have gradually entered an ultra-high water-cut period (water cut≥90%), which will make remaining oil distributed in an upper part of the reservoir difficult to be swept, affecting oil recovery; but remaining recoverable reserves is still nearly 50%, having a lot of tapping potential. However, existing oil displacement systems cannot efficiently use a large amount of remaining oil in low permeability area and the upper part of the reservoir, which is mainly affected by factors such as reservoir heterogeneity and gravity differentiation caused by difference between oil and water densities.

Currently, commonly used displacement systems mainly include carbon dioxide flooding, polymer flooding and supercritical carbon dioxide flooding, where the polymer flooding mainly increases a viscosity of a displacement fluid and reduces a mobility ratio of the displacement fluid to a displaced fluid, thereby expanding a swept volume, but after oilfields in high water cut period undergo long-term water flooding and polymer flooding, flow paths are usually formed at a bottom of the reservoir, resulting in inefficient or ineffective circulation of injection medium, intensified interlayer and intralayer contradictions in the reservoir, and highly dispersed remaining oil; the carbon dioxide flooding can enhance the oil recovery to a certain extent, but carbon dioxide and crude oil have a large mobility ratio, which leads to serious "gas channeling" phenomenon in top part of actual reservoir, affecting the swept volume and is not conducive to the displacement of crude oil; and the supercritical carbon dioxide ($scCO_2$) displacement system has a lower density than crude oil, can produce a floating effect within the formation, and has a potential of using the remaining oil in upper low-seepage area of the reservoir and in upper area of the used oil layers, so it is an oil recovery technology with great development potential, but there are still many technical problems in process of use, such as premature gas breakthrough and small sweep volume, which affect the recovery.

Therefore, there is an urgent need to develop a new oil displacement method to increase the swept volume of the reservoir and thereby enhance the oil recovery of crude oil.

SUMMARY

Aiming at the above shortcomings, the present disclosure provides an oil displacement method for ultra-high water-cut reservoirs, which can increase the swept volume of the reservoir and effectively improve the oil recovery of crude oil.

The present disclosure provides an oil displacement method for an ultra-high water-cut reservoir, including the following steps:

(1) injecting water into a reservoir to carry out a water flooding until the water cut of the reservoir is greater than 90%;

(2) injecting a polymer solution and a supercritical carbon dioxide oil displacement agent, respectively;

(3) injecting water to carry out a water flooding after injection of the polymer solution or the supercritical carbon dioxide oil displacement agent is completed;

injection amounts of both the polymer solution and the supercritical carbon dioxide oil displacement agent are not less than 0.1 Pore Volume (PV), and a total injection amount of the polymer solution and the supercritical carbon dioxide oil displacement agent is 0.3-1.2 PV;

a viscosity ratio of the polymer solution to a crude oil in the reservoir is 1:(0.8-10), and a viscosity ratio of the supercritical carbon dioxide oil displacement agent to the crude oil in the reservoir is 1:(10-800).

Further, a viscosity of the polymer solution is not less than 1 mPa s; and/or, a viscosity of the supercritical carbon dioxide oil displacement agent is greater than a viscosity of pure supercritical carbon dioxide and less than a viscosity of crude oil in the reservoir.

Further, the injection amount of the polymer solution is 0.1-0.6 PV, and/or the injection amount of the supercritical carbon dioxide oil displacement agent is 0.1-0.6 PV.

Further, step (2) is performed in multiple cycles; and the injection amount of the polymer solution is 0.05-0.2 PV, and the injection amount of the supercritical carbon dioxide oil displacement agent is 0.05-0.2 PV.

Further, an internal pressure of the reservoir is less than a miscible pressure of the supercritical carbon dioxide oil displacement agent and crude oil.

Further, the polymer solution includes both polymer and water, and the polymer includes at least one of xanthan gum, crosslinked polymer, hydrophobic associated polymer, comb polymer, and star polymer.

Further, the polymer solution further includes a surfactant and a basic compound, the surfactant includes at least one of non-ionic surfactant, anionic surfactant and zwitterionic surfactant; and the basic compound includes at least one of sodium hydroxide, sodium carbonate, sodium bicarbonate, and ammonium hydroxide.

Further, an average molecular weight of the polymer is 3 million to 21 million.

Further, the supercritical carbon dioxide oil displacement agent includes supercritical carbon dioxide and a base solution dissolved in the supercritical carbon dioxide, and the base solution includes a thickening agent, a cosolvent and water; in the base solution, a mass percentage content of the thickening agent is 0.05-3 wt %, a mass percentage content of the cosolvent is 0.05-6 wt %, and a balance is water; and the cosolvent includes at least one of kerosene, ether, and n-decane.

Further, the thickening agent includes at least one of siloxane-based thickening agent and hydrocarbon-based thickening agent, the siloxane-based thickening agent includes at least one of a compound represented by Formula 1, a compound represented by Formula 2, and a compound represented by Formula 3, Formula 1

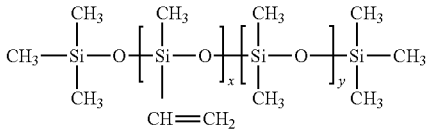

Formula 2

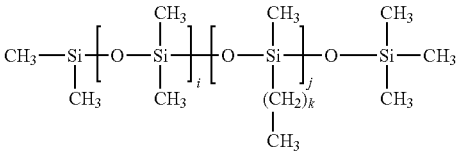

Formula 3

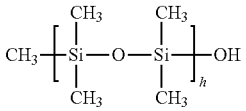

in Formula 1, x and y are each independently selected from a positive integer; in Formula 2, i, j, and k are each independently selected from a positive integer; and in Formula 3, h is selected from a positive integer;

the hydrocarbon-based thickening agent includes at least one of a compound represented by Formula 4, a compound represented by Formula 5, and a compound represented by Formula 6, Formula 4

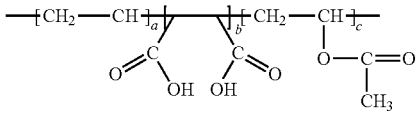

Formula 5

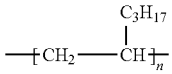

Formula 6

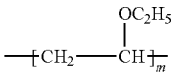

in Formula 4, a, b, and c are each independently selected from a positive integer; in Formula 5, n is selected from a positive integer; and in Formula 6, m is selected from a positive integer.

In the oil displacement method for an ultra-high water-cut reservoir disclosed by the present disclosure: firstly, carrying out a water flooding to the reservoir, to displace crude oil at bottom of the reservoir; when the water cut of the reservoir is greater than 90%, injecting a polymer solution of not less than 0.1 PV and a supercritical carbon dioxide oil displacement agent of not less than 0.1 PV into the reservoir, to further displace the crude oil at the bottom of the reservoir and at top of the reservoir respectively, where a total injection amount of the polymer solution and the supercritical carbon dioxide oil displacement agent is 0.3-1.2 PV; where when a viscosity ratio of the polymer solution to the crude oil in the reservoir is 1:(0.8-10), the polymer solution may not only block a dominant seepage channel formed by water flooding and increase a swept volume of subsequent water flooding and polymer flooding, but also form a large viscosity ratio to crude oil and weaken "fingering phenomenon", thereby increasing the swept volume of the polymer solution and improving the oil recovery of crude oil, and at the same time, because the polymer solution has certain viscoelasticity, it can also squeeze out the crude oil in a pore throat, improving oil washing efficiency; and the supercritical carbon dioxide oil displacement agent will spread to the upper part of the reservoir, and when the viscosity ratio of the supercritical carbon dioxide oil displacement agent to the crude oil in the reservoir is 1:(10-800), the "fingering phenomenon" can be weakened to further improve the swept volume and improve the oil recovery. After that, the oil recovery of crude oil can be enhanced comprehensively when water flooding is carried out.

DESCRIPTION OF EMBODIMENTS

Figure 1:
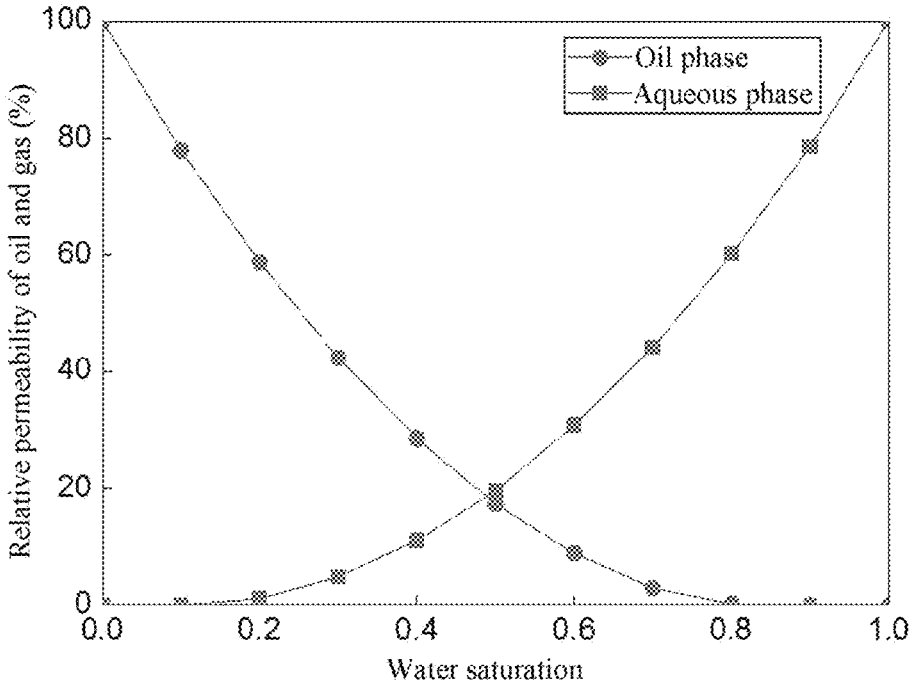
FIG. 1 is a relative permeability curve of oil and water of an ideal numerical simulation model of a five-point method according to the present disclosure.

In order to make the purpose, technical solution and advantages more clear, the technical solutions of the present disclosure will be described clearly and completely in combination with examples of the present disclosure. Obviously, the examples described are some not all of examples of the present disclosure. Based on the examples in the present disclosure, all other examples obtained by those skilled in the art without creative work fall within the protection scope of the present disclosure.

The present disclosure provides an oil displacement method for an ultra-high water-cut reservoir, including the following steps:

(1) injecting water into the reservoir to carry out a water flooding until a water cut of the reservoir is greater than 90%;

(2) injecting a polymer solution and a supercritical carbon dioxide oil displacement agent, respectively;

(3) injecting water to carry out a water flooding after injection of the polymer solution or the supercritical carbon dioxide oil displacement agent is completed;

where injection amounts of the polymer solution and the supercritical carbon dioxide oil displacement agent are each not less than 0.1 PV, and a total injection amount of the polymer solution and the supercritical carbon dioxide oil displacement agent is 0.3-1.2 PV; and a viscosity ratio of the polymer solution to a crude oil in the reservoir is 1:(0.8-10), and a viscosity ratio of the supercritical carbon dioxide oil displacement agent to the crude oil in the reservoir is 1:(10-800).

For example, the total injection amount of the polymer solution and the supercritical carbon dioxide oil displacement agent is 0.3 PV, 0.4 PV, 0.5 PV, 0.6 PV, 0.7 PV, 0.8 PV, 0.9 PV, 1.0 PV, 1.1 PV or 1.2 PV.

For example, the viscosity ratio of the polymer solution to the crude oil in the reservoir is 1:0.8, 1:1, 1:2, 1:3, 1:4, 1:5, 1:6, 1:7, 1:8, 1:9, or 1:10.

For example, the viscosity ratio of the supercritical carbon dioxide oil displacement agent to the crude oil in the reservoir is 1:10, 1:100, 1:200, 1:300, 1:400, 1:500, 1:600, 1:700, or 1:800.

Specifically, in step (1), the water cut of the reservoir can be calculated by Equation 1:

$$\text{water cut}(\%) = V_1/(V_1 + V_2) \qquad \text{Equation 1}$$

in Equation 1, $V_1$ represents a volume of recovered crude oil, and $V_2$ represents a volume of recovered water.

The present disclosure does not limit a thickness of the reservoir, in an embodiment, the thickness of the reservoir is not less than 10 m.

In step (2), the polymer solution and the supercritical carbon dioxide oil displacement agent are each injected into the reservoir with a water cut greater than 90%, where the injection amounts of the polymer solution and the supercritical carbon dioxide oil displacement agent are each not less than 0.1 PV, and the total injection amount of the polymer solution and the supercritical carbon dioxide oil displacement agent is 0.3-1.2 PV.

The present disclosure does not specifically limit an injection sequence of the polymer solution and the supercritical carbon dioxide oil displacement agent. The polymer solution may be injected first and then the supercritical carbon dioxide oil displacement agent may be injected; or the supercritical carbon dioxide oil displacement agent may be injected first and then the polymer solution may be injected.

The supercritical carbon dioxide oil displacement agent in the present disclosure refers to a system including supercritical carbon dioxide ($scCO_2$) and a base solution dissolved in the supercritical carbon dioxide.

Supercritical carbon dioxide in the present disclosure refers to carbon dioxide in a state between liquid and gas under conditions of higher than its critical temperature of 31.1° C. and critical pressure of 7.38 MPa.

In step (3), the water flooding continues after the injection of the polymer solution or the supercritical carbon dioxide oil displacement agent is completed.

In the oil displacement method of the present disclosure, water flooding on the reservoir is firstly carried out, and since the density of water is greater than that of crude oil, water flows at the bottom of the reservoir to displace the crude oil at the bottom of the reservoir, and when the water cut of the reservoir is greater than 90%, the polymer solution of not less than 0.1 PV and the supercritical carbon dioxide oil displacement agent of not less than 0.1 PV are injected into the reservoir, with the total injection amount of the polymer solution and the supercritical carbon dioxide oil displacement agent being 0.3-1.2 PV, to further displace the crude oil at the bottom of the reservoir and the top of the reservoir respectively; where the density of the polymer solution is greater than the density of the crude oil, and it will flow at the bottom of the reservoir, block the dominant seepage channel formed by water flooding, increase the swept volume of subsequent water flooding and polymer flooding and improve the oil recovery of crude oil, and the viscosity ratio of the polymer solution to the crude oil is 1:(0.8-10), which allows formation of a large viscosity ratio between the polymer solution and the crude oil, weakens the "fingering phenomenon", thereby further increasing the swept volume of the polymer solution and improving the oil recovery of the crude oil, and at the same time, since the polymer solution has a certain viscoelasticity, it can squeeze out the crude oil in the pore throat, improving oil washing efficiency; while the density of the supercritical carbon dioxide oil displacement agent is lower than that of the crude oil, so it will spread to the upper part of the reservoir and increase the swept volume, and when the viscosity ratio of the supercritical carbon dioxide oil displacement agent to the crude oil in the reservoir is 1:(10-800), a larger viscosity ratio can be formed between the supercritical carbon dioxide oil displacement agent and the crude oil, which can weaken the "fingering phenomenon", further increase the swept volume, and then improve the oil recovery. After that, the oil recovery of crude oil can be enhanced comprehensively when water flooding can be performed.

In addition, in the oil displacement method of the present disclosure, after injecting the supercritical carbon dioxide oil displacement agent, the density of the supercritical carbon dioxide oil displacement agent is similar to the density of crude oil, so it can be avoided that the supercritical carbon dioxide oil displacement agent directly passes through the top part of the reservoir during the oil displacement process due to too low density of the supercritical carbon dioxide oil displacement agent, so that the oil recovery of crude oil can be further improved.

In one specific embodiment, the viscosity of the polymer solution is not less than 1 mPa·s. Within this range, the polymer solution can form a larger viscosity ratio to the crude oil in the reservoir, further increasing the swept volume, and thereby improving the oil recovery of crude oil.

In one specific embodiment, the viscosity of the supercritical carbon dioxide oil displacement agent is greater than a viscosity of pure supercritical carbon dioxide and less than the viscosity of crude oil in the reservoir. The inventor of the present disclosure found that when the viscosity of the supercritical carbon dioxide oil displacement agent is greater than the viscosity of the crude oil in the reservoir, it is not conducive to further increasing the swept volume. Therefore, when the viscosity of the supercritical carbon dioxide oil displacement agent is greater than the viscosity of pure supercritical carbon dioxide and smaller than the viscosity of the crude oil in the reservoir, the swept volume of the supercritical carbon dioxide injected into the reservoir to the crude oil can be further increased, and at the same time, the cost can be reduced.

In one specific embodiment, the injection amount of the polymer solution is 0.1-0.6 PV. For example, the injection amount of the polymer solution is 0.1 PV, 0.2 PV, 0.3 PV, 0.4 PV, 0.5 PV or 0.6 PV. Within this range, it not only can further increase the swept volume of the polymer solution and improve the oil recovery, but also reduce costs and maximize economy.

In one specific embodiment, the injection amount of the supercritical carbon dioxide oil displacement agent is 0.1-0.6 PV. For example, the injection amount of the supercritical carbon dioxide oil displacement agent is 0.1 PV, 0.2 PV, 0.3 PV, 0.4 PV, 0.5 PV or 0.6 PV. Within this range, the supercritical carbon dioxide oil displacement agents can achieve high swept volume in reservoirs and save costs.

In one specific embodiment, step (2) is performed in multiple cycles; the injection amount of the polymer solution is 0.05-0.2 PV, and the injection amount of the supercritical carbon dioxide oil displacement agent is 0.05-0.2 PV. By performing step (2) in multiple cycles, that is, alternately injecting the polymer solution and the supercritical carbon dioxide oil displacement agent, a larger sweep volume can be achieved and the oil recovery of the crude oil can be further improved.

The present disclosure does not specifically limit the number of cycles, and only needs to make the injection amount of the polymer solution and the supercritical carbon dioxide oil displacement agent between 0.05 and 0.2 PV each time. For example, the injection amount of the polymer solution each time is 0.05 PV, 0.1 PV, 0.15 PV, or 0.2 PV; and for example, the injection amount of the supercritical carbon dioxide oil displacement agent each time is 0.05 PV, 0.1 PV, 0.15 PV, or 0.2 PV.

The present disclosure does not specifically limit injection times of the polymer solution and the supercritical carbon dioxide oil displacement agent. For example, it may be that the polymer solution is injected n times, the supercritical carbon dioxide oil displacement agent is injected n+1 times, or it may be that the polymer solution is injected n times, and the supercritical carbon dioxide oil displacement agent is injected n−1 times, or it may be that the polymer solution is injected n times, and the supercritical carbon dioxide oil displacement agent is injected n times.

In one specific embodiment, an internal pressure of the reservoir is less than a miscible pressure of the supercritical carbon dioxide oil displacement agent and the crude oil. The miscible pressure refers to the lowest pressure at which the supercritical carbon dioxide oil displacement agent reaches miscible phase with crude oil in the reservoir at temperature of the reservoir. When the internal pressure of the reservoir is less than the miscible pressure between the supercritical carbon dioxide oil displacement agent and the crude oil, the crude oil displacement effect can be improved, thereby improving the oil recovery of the crude oil.

In one specific embodiment, the polymer solution includes both a polymer and water; the polymer includes at least one of xanthan gum, cross-linked polymer, hydrophobic associated polymer, comb polymer, and star polymer. It can be understood that the above five types of compounds include multiple specific compounds, and the compounds selected in the present disclosure can be well dispersed and dissolved in water. When the above polymer is a mixture of multiple specific compounds, the present disclosure does not limit too much on a ratio between the specific compounds.

The present disclosure does not specifically limit a ratio of the polymer to water, as long as the ratio of the viscosity of the polymer solution prepared from polymer and water to the viscosity of the crude oil is between 1:(0.8-10).

The present disclosure does not specifically limit the source of the polymer, and it is possible to use commercially available products or products prepared by conventional preparation methods familiar to those skilled in the art.

In one specific embodiment, the polymer solution further includes a surfactant and a basic compound; the surfactant includes at least one of non-ionic surfactants, anionic surfactants, and zwitterionic surfactants; the basic compound includes at least one of sodium hydroxide, sodium carbonate, sodium bicarbonate, and ammonium hydroxide.

Further, the non-ionic surfactant includes at least one of long-chain amino surfactant, long-chain guanidine-based surfactant, and alkyl glycoside; the anionic surfactant may be selected from long-chain carboxylates and/or long-chain sulfates; and the zwitterionic surfactant may be selected from carboxylic betaine and/or sulfobetaine. Where the long-chain amino surfactant can be, for example, erucamide alkyldimethylamine (erucamide propyldimethylamine) and other long-chain alkyl amidodimethylamine, the long-chain guanidine-based surfactant can be dodecyl tetramethylguanidine and other long-chain alkyl tetramethylguanidine; the long-chain carboxylate can be at least one selected from sodium oleate, potassium oleate, and sodium linoleate; the long-chain sulfate can be sodium dodecyl sulfate and other long-chain alkyl sodium sulfate; the carboxylic acid betaine can be selected from long-chain alkyl carboxylic acid betaine and/or fatty amide carboxylic acid betaine; the sulfobetaines may be selected from at least one of long-chain alkyl sulfobetaine, fatty amide propyl sulfobetaine, and fatty amide hydroxypropyl sulfobetaine. Specifically, the above-mentioned "long chain" generally refers to C12 or above, such as C12-C18, etc. When the surfactant is a mixture of multiple specific compounds, the present disclosure does not limit too much on the ratio between the specific compounds.

The present disclosure does not specifically limit the source of the surfactant, and it is possible to use commercially available products or products prepared by conventional preparation methods familiar to those skilled in the art.

Further, when the basic compound is a mixture of multiple specific compounds, the ratio between the specific compounds is not too limited.

In one specific embodiment, an average molecular weight of the polymer ranges from 3 million to 21 million. For example, the average molecular weight of the polymer is 3 million, 5 million, 7 million, 9 million, 11 million, 13 million, 15 million, 17 million, 19 million, or 21 million. Within this range, it can better match the pore throat size in the reservoir, and further improve the recovery effect of the crude oil.

In a specific embodiment, the supercritical carbon dioxide oil displacement agent includes supercritical carbon dioxide and a base solution dissolved in the supercritical carbon dioxide, and the base solution includes a thickening agent, a cosolvent, and water; in the base solution, the mass percentage content of the thickening agent is 0.05-3 wt %, the mass percentage content of the cosolvent is 0.05-6 wt %, and a balance is water.

The cosolvent includes at least one of kerosene, ether, and n-decane.

For example, the mass percentage content of the thickening agent is 0.05 wt %, 0.5 wt %, 1 wt %, 1.5 wt %, 2 wt %, 2.5 wt % or 3 wt %, and the mass percentage content of the cosolvent is 0.05 wt %, 1 wt %, 2 wt %, 3 wt %, 4 wt %, 5 wt % or 6 wt %.

When a composition of the supercritical carbon dioxide oil displacement agent is as above and the mass percentage content of each component is in the above range, the viscosity characteristic of the supercritical carbon dioxide oil displacement agent can be further improved, the viscosity ratio of the supercritical carbon dioxide oil displacement agent to the crude oil can be further improved, and the oil recovery of the crude oil can be further improved.

The present disclosure does not specifically limit a ratio of the supercritical carbon dioxide oil displacement agent to the base solution, as long as the viscosity ratio of the supercritical carbon dioxide oil displacement agent prepared by the supercritical carbon dioxide and the base solution to the crude oil in the reservoir can be between 1:(10-800).

In a specific embodiment, the thickening agent includes at least one of siloxane-based thickening agent and hydrocarbon-based thickening agent;

the siloxane-based thickening agent includes at least one of a compounds shown in Formula 1, a compounds shown in Formula 2, and a compounds shown in Formula 3, Formula 1

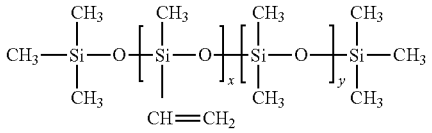

Formula 2

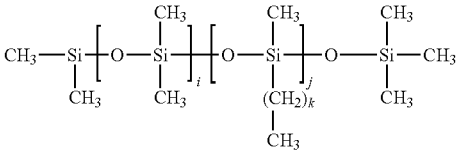

Formula 3

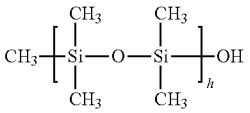

in Formula 1, x and y are each independently selected from a positive integer; in Formula 2, i, j, and k are each independently selected from a positive integer; and in Formula 3, h is selected from a positive integer; and the hydrocarbon-based thickening agent comprises at least one of a compound represented by Formula 4, a compound represented by Formula 5, and a compound represented by Formula 6, Formula 4

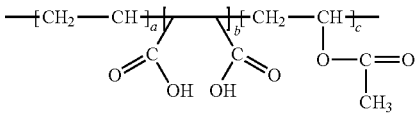

Formula 5

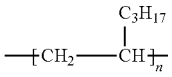

Formula 6

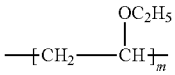

in Formula 4, a, b, and c are each independently selected from a positive integer; in Formula 5, n is selected from a positive integer; and in Formula 6, m is selected from a positive integer.

The present disclosure does not specifically limit the source of the thickening agent, and it is possible to use commercially available products or products prepared by conventional preparation methods familiar to those skilled in the art.

The present disclosure does not specifically limit the preparation method of the supercritical carbon dioxide oil displacement agent. For example, the supercritical carbon dioxide oil displacement agent can be prepared by a method including the following processes. A thickening agent and a cosolvent are added to water and stirred until dissolved, to be prepared into a base solution; under supercritical condition of carbon dioxide, the base solution and supercritical carbon dioxide are mixed and dissolved to obtain a supercritical carbon dioxide oil displacement agent. Generally, the above-mentioned supercritical condition of carbon dioxide can be regulated and controlled by conventional methods in the art. In one embodiment, a conventional intermediate container can be used to prepare a supercritical carbon dioxide oil displacement agent. By regulating and controlling conditions such as temperature and pressure in the intermediate container, the supercritical condition that enables carbon dioxide to be in a supercritical state is controlled. Specifically, an interior of the intermediate container is divided into two parts, i.e., an upper part and a lower part, through a piston, where the upper part is used to prepare the supercritical carbon dioxide oil displacement agent, and the lower part contains water and other medium, and the lower part can be communicated with a device containing water and other medium through an isco pump or the like. Through the isco pump, water and other medium can be introduced into/sucked out of the lower part of the intermediate container to move the piston and change the volume of the upper part of the intermediate container, thereby realizing control of the pressure of the upper part of the intermediate container; and at the same time, the intermediate container can be placed in an incubator to realize control of the temperature in the intermediate container.

In the following, different methods are used to describe the oil displacement method for an ultra-high water-cut reservoir included in the present disclosure in detail through specific examples.

1. Numerical Simulation Method

Figure 2:
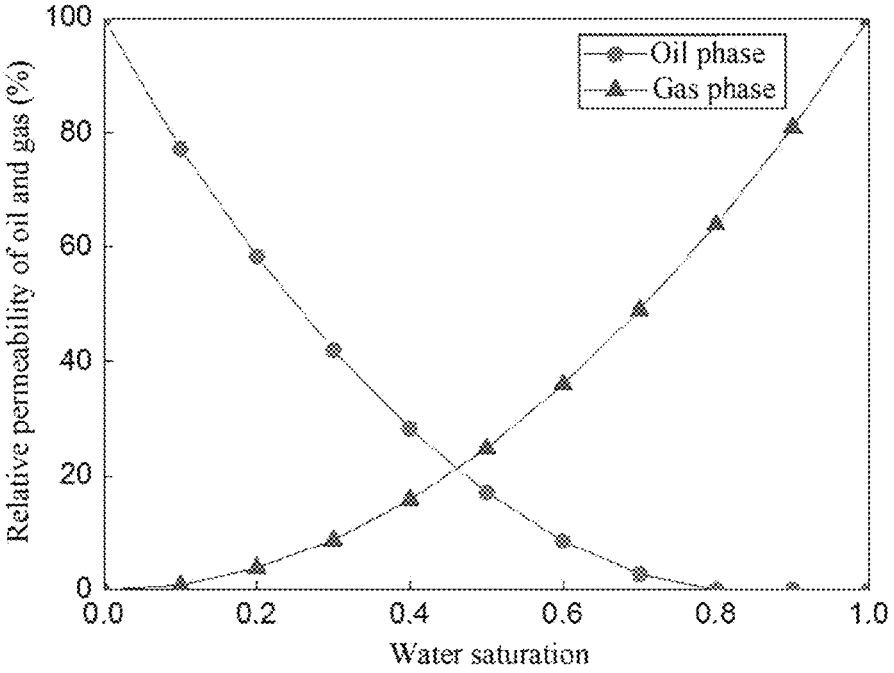
FIG. 2 is a relative permeability curve of oil and gas of an ideal numerical simulation model of a five-point method according to the present disclosure.
Figure 3:
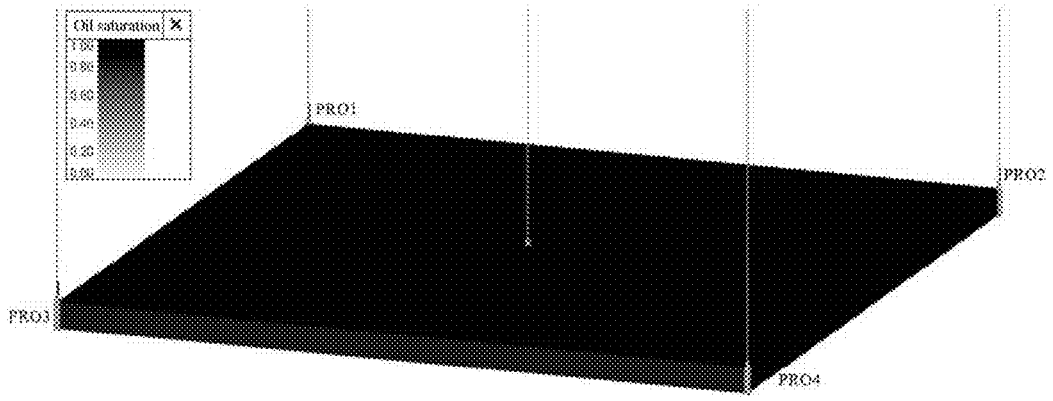
FIG. 3 is a diagram of an oil saturation of an original reservoir in an ideal numerical simulation model of a five-point method according to the present disclosure.

In order to study the oil displacement effect of oil displacement method of the ultra-high water-cut reservoir of the present disclosure, an ideal model of 5-point well network containing 1 injection well and 4 production wells was established, and the model includes gas, water and oil three phases. Using a black oil simulator, under a fixed injection speed system, an injection speed of polymer solution was 1000 $m^3$/d, an injection speed of supercritical carbon dioxide oil displacement agent was 12000 $m^3$/d, a bottom hole pressure of the injection well was 40 MPa, a bottom hole pressure of the production wells was 8 MPa, and a simulation time was 60 years. Table 1 shows basic parameters of the ideal numerical simulation model of the five-point method; FIG. 1 is a relative permeability curve of oil and water of the ideal numerical simulation model of the five-point method, FIG. 2 is a relative permeability curve of oil and gas of the ideal numerical simulation model of the five-point method, and FIG. 3 is a diagram of an oil saturation of an original reservoir in the ideal numerical simulation model of the five-point method.

TABLE 1

| Parameters | Parameter values |
|---|---|
| Mesh dimension | I*J*K = 80*80*10 |
| Mesh size (m) | L*W*H = 10*10*3 |
| Depth (m) | 500 |
| Permeability ($10^{-3}$ $\mu m^2$) | PERMX*PERMX*PERMX = 500*500*50 |
| Porosity | 0.28 |
| Density (kg/$m^3$) | Water: 1000; Crude oil: 850; Polymer solution: 1000; $scCO_2$: 540 |
| Viscosity (mPa · s) | Water: 0.6; Crude oil: 12; Polymer solution: 8; $scCO_2$: 0.014 |
| Concentration of polymer solution (kg/$m^3$) | 0.8 |

Figure 4:
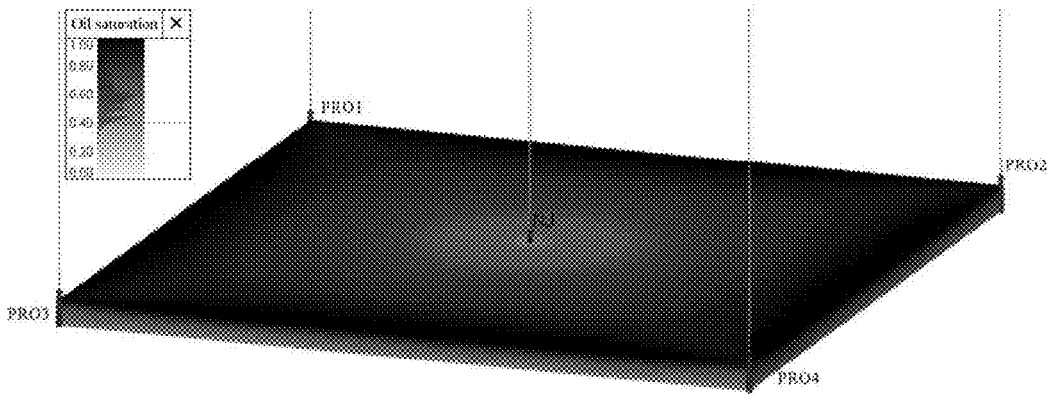
FIG. 4 is a diagram of an oil saturation of a reservoir when a water cut of the reservoir reaches 90% in an ideal numerical simulation model of a five-point method according to the present disclosure.

Water flooding was performed on the above reservoir model until the water cut reaches 90%, and at this time the oil recovery of crude oil is 26.25%. On the basis of water cut of the reservoir reaching 90%, the oil recovery of crude oil under different displacement methods is simulated. FIG. 4 is a diagram of an oil saturation of the reservoir when the water cut of the reservoir reaches 90% in the ideal numerical simulation model of the five-point method.

Example 1

0.2 PV of supercritical carbon dioxide oil displacement agent (viscosity: 1.12 mPa·s) was continued to be injected into the above reservoir model with a water cut of 90%, and then 0.2 PV of polymer solution (viscosity: 8 mPa·s) was injected, and then water flooding was performed. When the water cut of the reservoir reached more than 98%, the oil recovery of crude oil is 62.81%.

Example 2

0.2 PV of polymer solution (viscosity: 8 mPa·s) was continued to be injected into the above reservoir model with a water cut of 90%, and then 0.2 PV of supercritical carbon dioxide oil displacement agent (viscosity: 1.12 mPa·s) was injected, and then water flooding was performed. When the water cut of the reservoir reached more than 98%, the oil recovery of crude oil is 62.15%.

Figure 5:
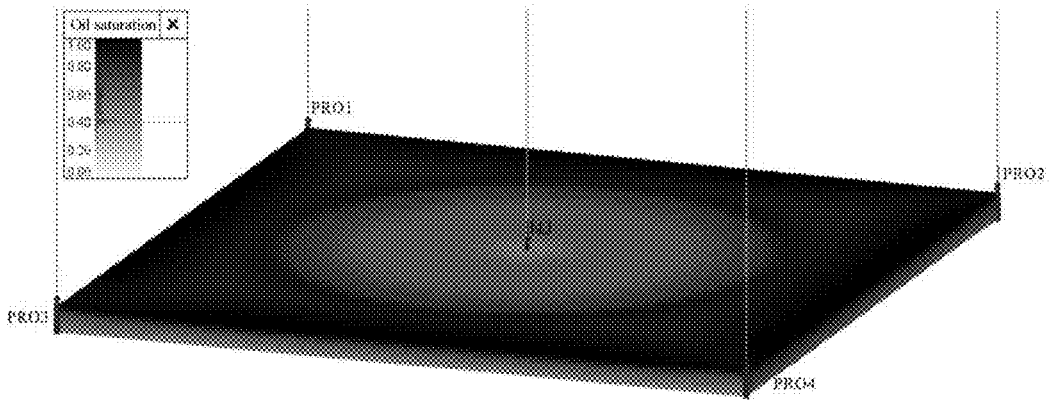
FIG. 5 is a diagram of an oil saturation of a reservoir after injection of 0.2 PV polymer solution in Example 2 of the present disclosure.
Figure 6:
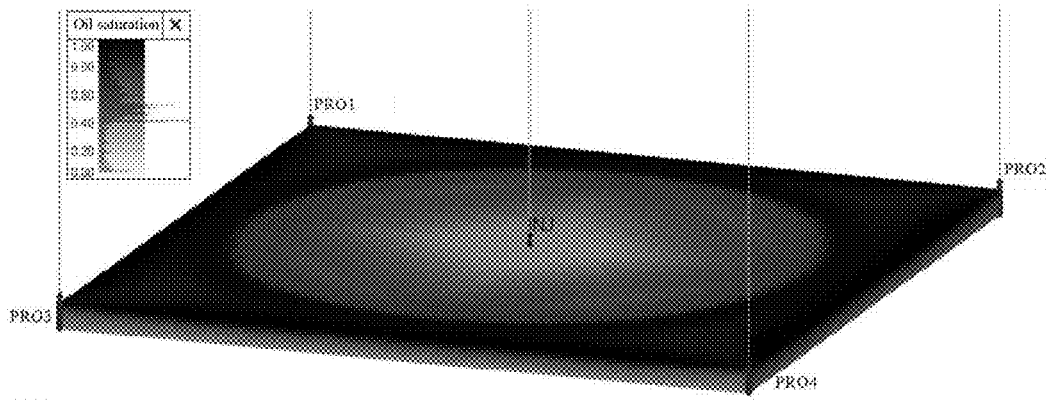
FIG. 6 is a diagram of the oil saturation of the reservoir after injection of 0.2 PV supercritical carbon dioxide oil displacement agent in Example 2 of the present disclosure.
Figure 7:
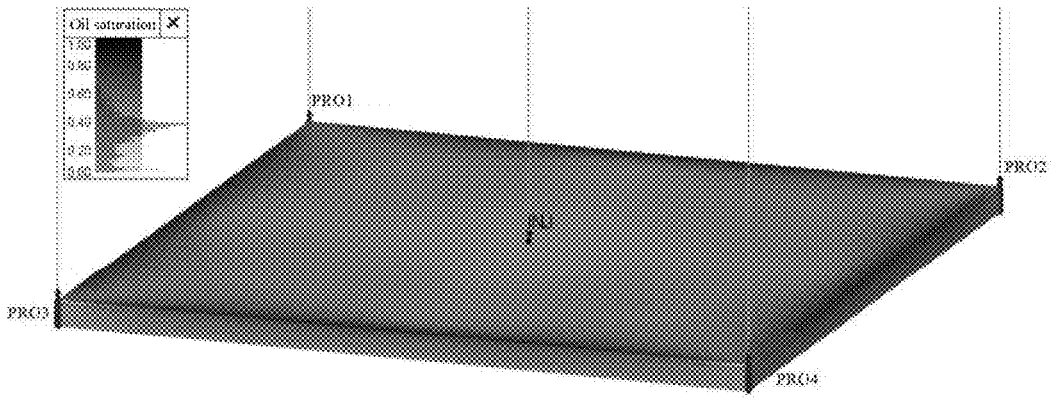
FIG. 7 is a diagram of the oil saturation of the reservoir when a water cut of the reservoir reaches more than 98% in Example 2 of the present disclosure.

FIG. 5 is a diagram of an oil saturation of a reservoir after injection of 0.2 PV polymer solution, FIG. 6 is a diagram of the oil saturation of the reservoir after injection of 0.2 PV supercritical carbon dioxide oil displacement agent, and FIG. 7 is a diagram of the oil saturation of the reservoir when the water cut of the reservoir reached more than 98%.

Example 3

0.1 PV of polymer solution (viscosity: 8 mPa·s) was continued to be injected into the above reservoir model with a water cut of 90%, and then 0.1 PV of supercritical carbon dioxide oil displacement agent (viscosity: 1.12 mPa·s) was injected, and then 0.1 PV of polymer solution (viscosity: 8 mPa·s) and 0.1 PV of supercritical carbon dioxide oil displacement agent (viscosity: 1.12 mPa·s) were injected in sequence, and then water flooding was performed. When the water cut of the reservoir reached more than 98%, the oil recovery of crude oil is 64.11%.

Figure 8:
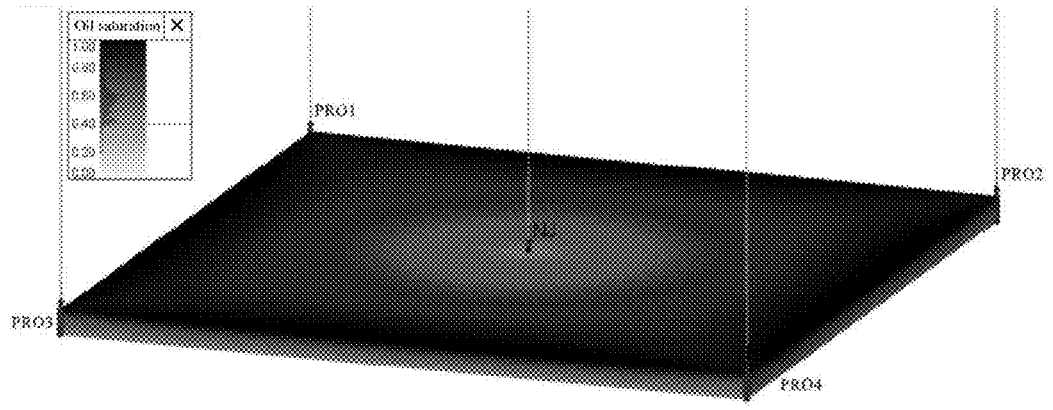
FIG. 8 is a diagram of an oil saturation of a reservoir after injection of 0.1 PV polymer solution in Example 3 of the present disclosure.
Figure 9:
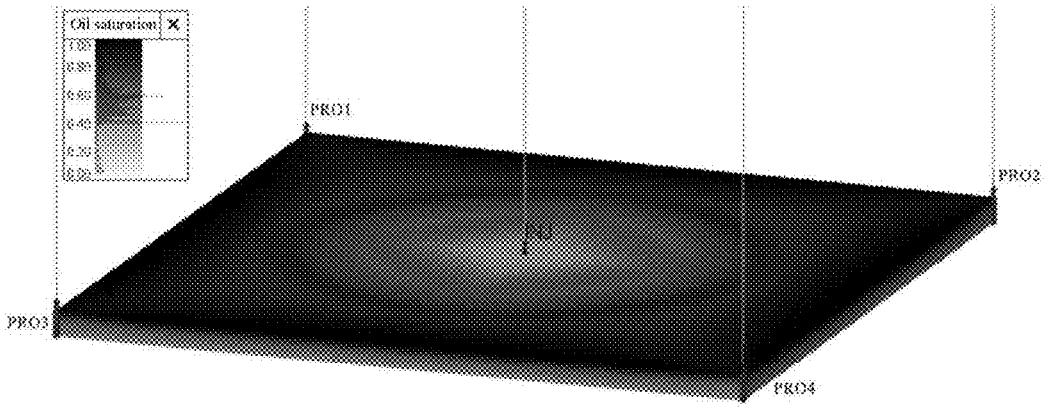
FIG. 9 is a diagram of the oil saturation of the reservoir after injection of 0.1 PV supercritical carbon dioxide oil displacement agent in Example 3 of the present disclosure.
Figure 10:
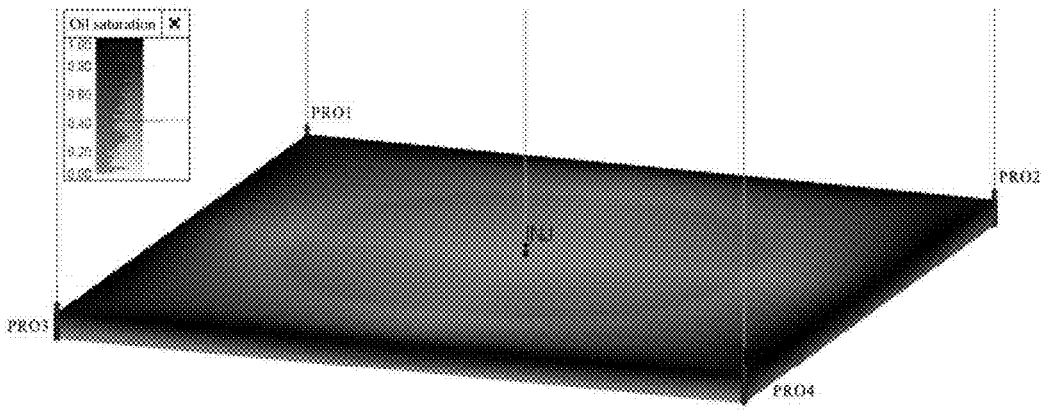
FIG. 10 is a diagram of the oil saturation of the reservoir after re-injection of 0.1 PV of the polymer solution in Example 3 of the present disclosure.
Figure 11:
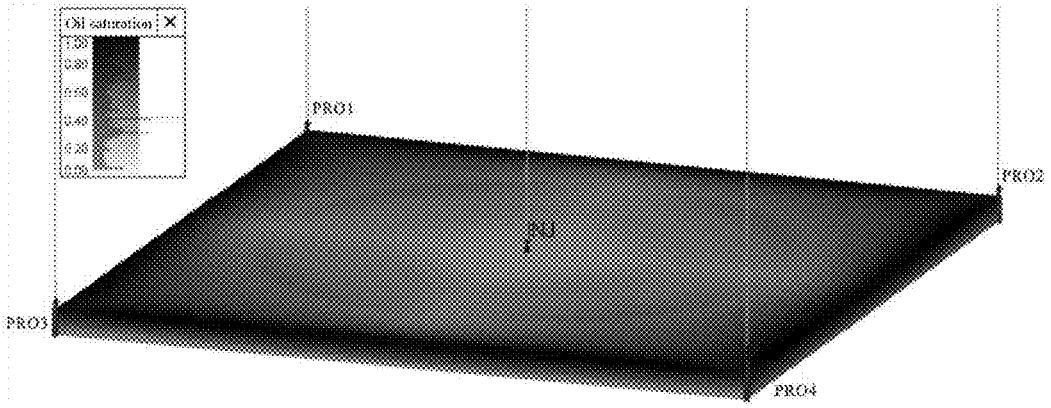
FIG. 11 is a diagram of the oil saturation of the reservoir after re-injection of 0.1 PV of the supercritical carbon dioxide oil displacement agent in Example 3 of the present disclosure.
Figure 12:
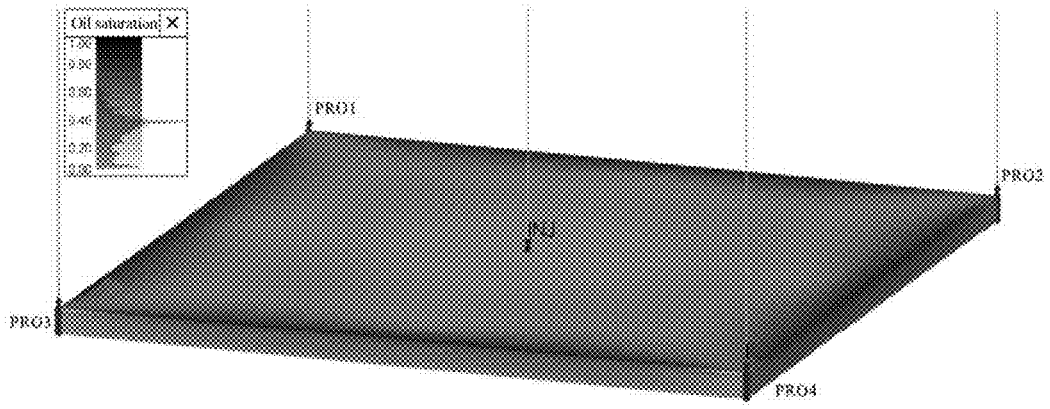
FIG. 12 is a diagram of the oil saturation of the reservoir when a water cut of the reservoir reaches more than 98% in Example 3 of the present disclosure.

FIG. 8 is a diagram of an oil saturation of the reservoir after injection of 0.1 PV polymer solution, FIG. 9 is a diagram of the oil saturation of the reservoir after injection of 0.1 PV supercritical carbon dioxide oil displacement agent, FIG. 10 is a diagram of the oil saturation of the reservoir after re-injection of 0.1 PV of polymer solution, FIG. 11 is a diagram of the oil saturation of the reservoir after re-injection of 0.1 PV of supercritical carbon dioxide oil displacement agent, and FIG. 12 is a diagram of the oil saturation of the reservoir when the water cut of the reservoir reached more than 98%.

Example 4

0.05 PV of polymer solution (viscosity: 8 mPa·s) and 0.05 PV of supercritical carbon dioxide oil displacement agent (viscosity: 1.12 mPa·s) were injected in sequence into the above reservoir model with a water cut of 90%. The injection was circulated four times according to the above injection method, and then water flooding was performed. When the water cut of the reservoir reached more than 98%, the oil recovery of crude oil is 81.31%.

Example 5

The oil displacement method for an ultra-high water-cut reservoir in this example is basically the same as that in Example 1, except that the injection amount of the polymer solution is changed. Specifically, 0.2 PV of supercritical carbon dioxide oil displacement agent (viscosity: 1.12 mPa·s) was continued to be injected into the reservoir model with a water cut of 90%, and then 0.8 PV of polymer solution (viscosity: 8 mPa·s) was injected, and then water flooding was performed. When the water cut of the reservoir reached more than 98%, the oil recovery of crude oil is 73.34%.

Example 6

The oil displacement method for an ultra-high water-cut reservoir in this example is basically the same as that in Example 1, except that the injection amount of the supercritical carbon dioxide oil displacement agent is changed, specifically as follows: 0.8 PV of supercritical carbon dioxide oil displacement agent (viscosity: 1.12 mPa·s) was continued to be injected into the above reservoir model with a water cut of 90%, and then 0.2 PV of polymer solution (viscosity: 8 mPa·s) was injected, and then water flooding was performed. When the water cut of the reservoir reached more than 98%, the oil recovery of crude oil is 74.48%.

Comparative Example 1

Water was continued to be injected into the above reservoir model with a water cut of 90%, to perform water flooding. When the water cut of the reservoir reached more than 98%, the oil recovery of crude oil is 44.15%.

Comparative Example 2

0.2 PV of polymer solution (viscosity: 8 mPa·s) was continued to be injected into the above reservoir model with a water cut of 90%, and then water flooding was performed. When the water cut of the reservoir reached more than 98%, the oil recovery of crude oil is 45.60%.

Comparative Example 3

0.2 PV of pure supercritical carbon dioxide (viscosity: 0.014 mPa·s) was continued to be injected into the above reservoir model with a water cut of 90%, and then water flooding was performed. When the reservoir water cut reached more than 98%, the oil recovery of crude oil is 46.17%.

Comparative Example 4

0.4 PV of polymer solution (viscosity: 8 mPa·s) was continued to be injected into the above reservoir model with a water cut of 90%, and then water flooding was performed. When the water cut of the reservoir reached more than 98%, the oil recovery of crude oil is 48.18%.

Figure 13:
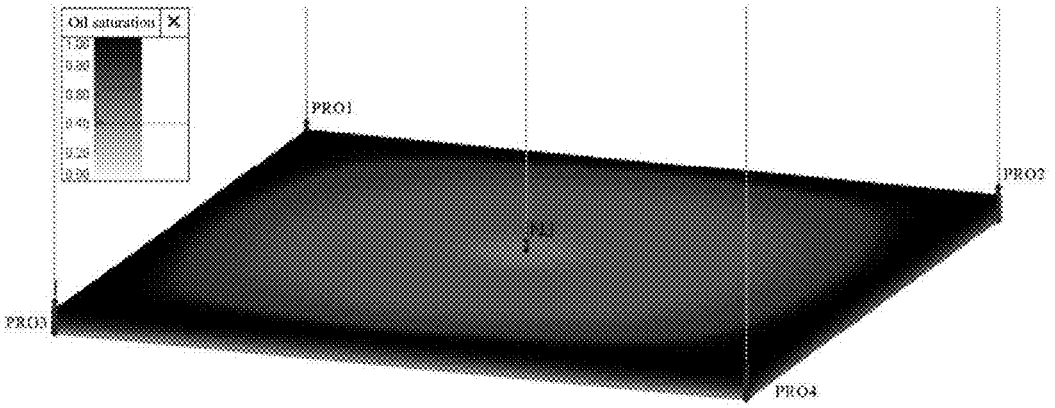
FIG. 13 is a diagram of an oil saturation of a reservoir after injection of 0.4 PV polymer solution in Comparative Example 4 of the present disclosure.
Figure 14:
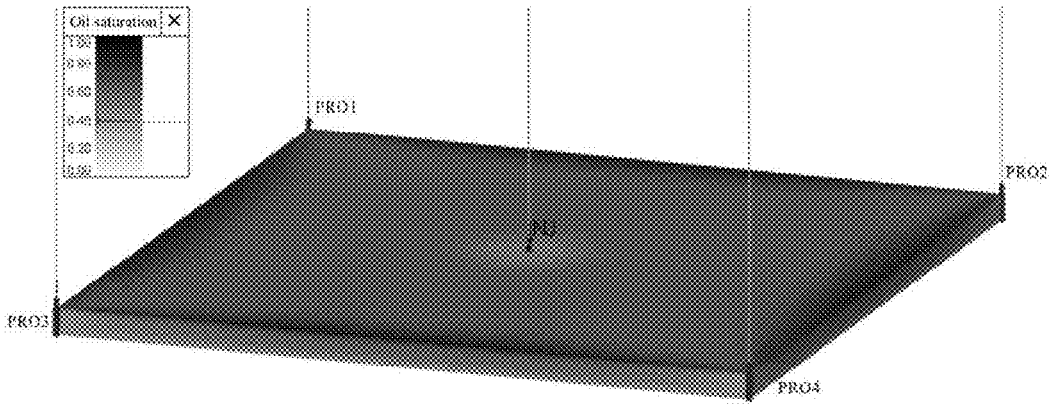
FIG. 14 is a diagram of the oil saturation of the reservoir when a water cut of the reservoir reaches more than 98% in Comparative Example 4 of the present disclosure.

FIG. 13 is a diagram of the oil saturation of the reservoir after injection of 0.4 PV polymer solution, and FIG. 14 is a diagram of the oil saturation of the reservoir when the water cut of the reservoir reached more than 98%.

Comparative Example 5

0.4 PV of pure supercritical carbon dioxide (viscosity: 0.014 mPa·s) was continued to be injected into the above reservoir model with a water cut of 90%, and then water flooding was performed. When the reservoir water cut reached more than 98%, the oil recovery of crude oil is 46.95%.

Comparative Example 6

0.4 PV of supercritical carbon dioxide oil displacement agent (viscosity: 0.14 mPa·s) was continued to be injected into the above reservoir model with a water cut of 90%, and then water flooding was performed. When the reservoir water cut reached more than 98%, the oil recovery of crude oil is 52.50%.

Comparative Example 7

0.4 PV of supercritical carbon dioxide oil displacement agent (viscosity: 0.28 mPa·s) was continued to be injected into the above reservoir model with a water cut of 90%, and then water flooding was performed. When the reservoir water cut reached more than 98%, the oil recovery of crude oil is 55.36%.

Comparative Example 8

0.4 PV of supercritical carbon dioxide oil displacement agent (viscosity: 0.56 mPa·s) was continued to be injected into the above reservoir model with a water cut of 90%, and then water flooding was performed. When the reservoir water cut reached more than 98%, the oil recovery of crude oil is 50.45%.

Comparative Example 9

0.4 PV of supercritical carbon dioxide oil displacement agent (viscosity: 1.12 mPa·s) was continued to be injected into the above reservoir model with a water cut of 90%, and then water flooding was performed. When the reservoir water cut reached more than 98%, the oil recovery of crude oil is 54.22%.

Figure 15:
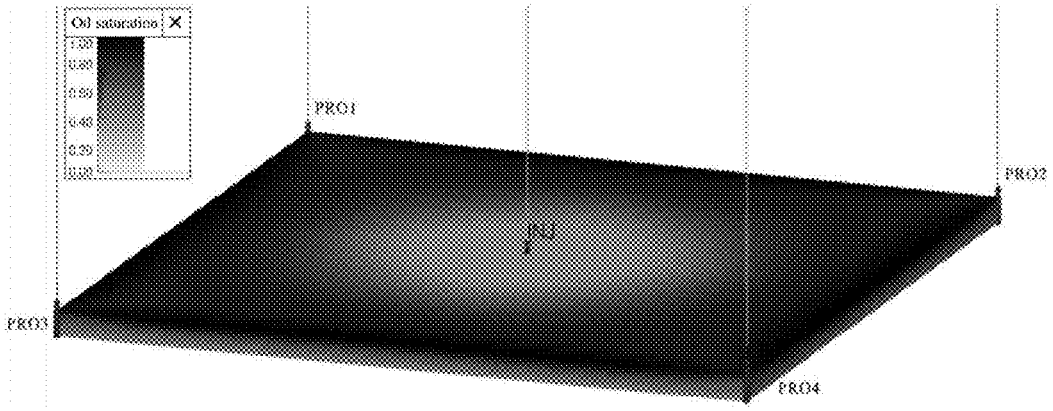
FIG. 15 is a diagram of an oil saturation of a reservoir after injection of 0.4 PV supercritical carbon dioxide oil displacement agent in Comparative Example 9 of the present disclosure.
Figure 16:
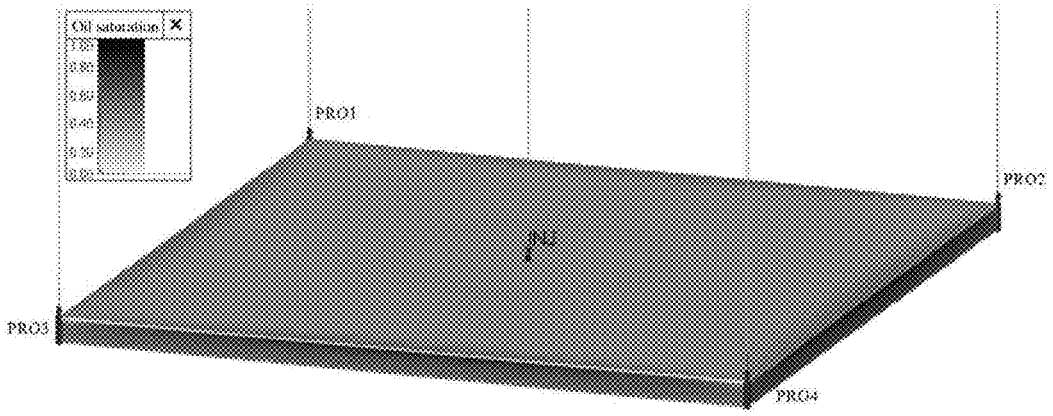
FIG. 16 is a diagram of the oil saturation of the reservoir when a water cut of the reservoir reaches more than 98% in Comparative Example 9 of the present disclosure.

FIG. 15 is a diagram of the oil saturation of the reservoir after injection of 0.4 PV supercritical carbon dioxide oil displacement agent, and FIG. 16 is a diagram of the oil saturation of the reservoir when the water cut of the reservoir reached more than 98%.

Comparative Example 10

The oil displacement method for the ultra-high water-cut reservoir in this comparative example is basically the same as that in Example 1, except that the injection amounts of the supercritical carbon dioxide oil displacement agent and the polymer solution are changed to make the injection amounts of both lower than 0.1 PV, and specifically: 0.08 PV of supercritical carbon dioxide oil displacement agent (viscosity: 1. 12 mPa·s) was continued to be injected into the above reservoir model with a water cut of 90%, and then 0.08 PV of polymer solution (viscosity: 8 mPa·s) was injected, and then water flooding was performed. When the water cut of the reservoir reached more than 98%, the oil recovery of crude oil is 43.40%.

Comparative Example 11

The oil displacement method for the ultra-high water-cut reservoir in this comparative example is basically the same as that in Example 1, except that the injection amounts of supercritical carbon dioxide oil displacement agent and polymer solution are changed to make the total injection amount of both greater than 1.2 PV, and specifically: 0.65 PV of supercritical carbon dioxide oil displacement agent (viscosity: 1.12 mPa·s) was continued to be injected into the above reservoir model with a water cut of 90%, and then 0.65 PV of polymer solution (viscosity: 8 mPa·s) was injected, and then water flooding was performed. When the water cut of the reservoir reached more than 98%, the oil recovery of crude oil is 76.28%.

Comparative Example 12

The oil displacement method for the ultra-high water-cut reservoir in this comparative example is basically the same as that in Example 1, except that the viscosity of the polymer solution is changed to make the viscosity ratio of the polymer solution to the crude oil in the reservoir be 1:0.6, and specifically: 0.2 PV of supercritical carbon dioxide oil displacement agent (viscosity: 1.12 mPa·s) was continued to be injected into the above reservoir model with a water cut of 90%, and then 0.2 PV of polymer solution (viscosity: 20 mPa·s) was injected, and then water flooding was performed. When the water cut of the reservoir reached more than 98%, the oil recovery of crude oil is 51.73%.

Comparative Example 13

The oil displacement method for the ultra-high water-cut reservoir in this comparative example is basically the same as that in Example 1, except that the viscosity of the polymer solution is changed to make the viscosity ratio of the polymer solution to the crude oil in the reservoir be 1:12, and specifically: 0.2 PV of supercritical carbon dioxide oil displacement agent (viscosity: 1.12 mPa·s) was continued to be injected into the above reservoir model with a water cut of 90%, and then 0.2 PV of polymer solution (viscosity: 1 mPa·s) was injected, and then water flooding was performed. When the water cut of the reservoir reached more than 98%, the oil recovery of crude oil is 43.02%.

Comparative Example 14

The oil displacement method for the ultra-high water-cut reservoir in this comparative example is basically the same as that in Example 1, except that the viscosity of the supercritical carbon dioxide oil displacement agent is changed to make the viscosity ratio of the supercritical carbon dioxide oil displacement agent to the crude oil in the reservoir 1:850, and specifically: 0.2 PV of supercritical carbon dioxide oil displacement agent (viscosity: 0.0141 mPa·s) was continued to be injected into the above reservoir model with a water cut of 90%, and then 0.2 PV of polymer solution (viscosity: 8 mPa·s) was injected, and then water flooding was performed. When the water cut of the reservoir reached more than 98%, the oil recovery of crude oil is 46.52%.

Specific data are shown in Table 2.

TABLE 2

| | Viscosity of polymer solution mPa · s | Viscosity of supercritical carbon dioxide oil displacement agent mPa · s | Viscosity ratio of polymer solution to crude oil | Viscosity ratio of supercritical carbon dioxide oil displacement agent to crude oil | Injection amount of polymer solution PV | Injection amount of supercritical carbon dioxide oil displacement agent PV | Alternate injection time | The oil recovery of crude oil % |
|---|---|---|---|---|---|---|---|---|
| Example 1 | 8 | 1.12 | 1:1.5 | 1:11 | 0.2 | 0.2 | 0 | 62.81 |
| Example 2 | 8 | 1.12 | 1:1.5 | 1:11 | 0.2 | 0.2 | 0 | 62.15 |
| Example 3 | 8 | 1.12 | 1:1.5 | 1:11 | 0.1 | 0.1 | 2 | 64.11 |
| Example 4 | 8 | 1.12 | 1:1.5 | 1:11 | 0.05 | 0.05 | 4 | 81.31 |
| Example 5 | 8 | 1.12 | 1:1.5 | 1:11 | 0.8 | 0.2 | 0 | 73.34 |
| Example 6 | 8 | 1.12 | 1:1.5 | 1:11 | 0.2 | 0.8 | 0 | 74.48 |
| Comparative Example 1 | / | / | / | / | / | / | / | 44.15 |
| Comparative Example 2 | 8 | / | 1:1.5 | / | 0.2 | / | / | 45.60 |
| Comparative Example 3 | / | / | / | / | / | 0.2 (Pure supercritical $CO_2$) | / | 46.17 |
| Comparative Example 4 | 8 | / | 1:1.5 | / | 0.4 | / | / | 48.18 |
| Comparative Example 5 | / | / | / | / | / | 0.4 (Pure supercritical $CO_2$) | / | 46.95 |
| Comparative Example 6 | / | 0.14 | / | 1:86 | / | 0.4 | / | 52.50 |
| Comparative Example 7 | / | 0.28 | / | 1:43 | / | 0.4 | / | 55.36 |
| Comparative Example 8 | / | 0.56 | / | 1:21 | / | 0.4 | / | 50.45 |
| Comparative Example 9 | / | 1.12 | / | 1:11 | / | 0.4 | / | 54.22 |
| Comparative Example 10 | 8 | 1.12 | 1:1.5 | 1:11 | 0.08 | 0.08 | 0 | 43.40 |
| Comparative Example 11 | 8 | 1.12 | 1:1.5 | 1:11 | 0.65 | 0.65 | 0 | 76.28 |
| Comparative Example 12 | 20 | 1.12 | 1:0.6 | 1:11 | 0.2 | 0.2 | 0 | 51.73 |
| Comparative Example 13 | 1 | 1.12 | 1:12 | 1:11 | 0.2 | 0.2 | 0 | 43.02 |
| Comparative Example 14 | 8 | 0.0141 | 1:1.5 | 1:850 | 0.2 | 0.2 | 0 | 46.52 |

It can be seen from Tables 1 and 2:

Compared with Comparative Examples 1-10 and Comparative Examples 12-14, the oil displacement methods for ultra-high water-cut reservoirs in Examples 1-6 can achieve higher the oil recovery of crude oil, up to 81.31%; where although the oil recovery of crude oil of Examples 5 and 6 were higher than that of Example 1, the injection amounts of polymer solution or supercritical carbon dioxide oil displacement agent were also larger during the injection process, so there are shortcomings in terms of improving economic benefits; Comparative Example 11 had higher the oil recovery of crude oil than Example 1, but had higher cost and lower economic benefits. It can be seen that the oil displacement method for ultra-high water-cut reservoirs of the present disclosure can increase the swept volume of the reservoir and significantly improve the oil recovery of crude oil.

It can be seen from FIGS. 3-7 that in Example 2, when the water cut reached 90% and 0.2 PV of polymer solution and 0.2 PV of thickened supercritical CO2 were injected into the reservoir respectively, a continuous decline in oil saturation of the reservoir occurred. After water flooding until the water cut reached 98%, the oil saturation of the entire reservoir decreased significantly.

It can be seen from FIGS. 8-12 that in Example 3, when the water cut reached 90% and 0.1 PV of polymer solution and thickened supercritical CO2 were alternately injected into the reservoir twice, the overall oil saturation of the reservoir also continued to decrease. After water flooding until the water cut reached 98%, the final overall oil saturation of the reservoir is higher than that of Example 2, indicating that increased number of alternation improved the overall the oil recovery of the reservoir.

It can be seen from FIGS. 13 and 14 that in Comparative Example 4, after the water cut reached 90% and only 0.4 PV of polymer solution was injected, compared with the results of Example 2 or 3 where the alternating total injection amount is 0.4 PV, the oil saturation field was higher, indicating a poor effect in enhancement of the oil recovery, which shows that the injection method of the present disclosure is significantly better than the single injection method.

It can be seen from FIGS. 15 and 16 that in Comparative Example 9, after the water cut reached 90% and only 0.4 PV of thickened supercritical C02 was injected, compared with the results of Example 2 or 3 where the alternating total injection amount is 0.4 PV, the oil saturation field was higher, indicating a poor effect in enhancement of the oil recovery, which shows that the injection method of the present disclosure is significantly better than the single injection method.

2. Indoor Test Method

In order to study the influence of polymer solutions with different components and supercritical carbon dioxide oil displacement agents of the present disclosure on the oil displacement effect, a cuboid artificial rock core with a size of 4.5×4.5×30 cm was used, and the average air permeability of the rock core was 500 mD; test fluid was prepared, where the simulation oil is Daqing Oilfield crude oil, the viscosity is 12 mPa·s, the temperature is 45° C., and the pressure is 10 Mpa, and the simulation water ion content is as shown in Table 3.

TABLE 3

| Ion type | $K^+ + Na^+$ | $Ca^{2+}$ | $HCO_3^-$ | $Cl^-$ | $CO3^{2-}$ | Total salinity |
|---|---|---|---|---|---|---|
| Content (mg/L) | 1768 | 122.75 | 884.79 | 2357.89 | 60.02 | 5193.46 |

Step 1: Weighing the above rock core and placing it in a core holder, vacuumizing under a confining pressure of 2 MPa for 24 h, then connecting an inlet end of the core holder with simulation water, flooding 30 PV with the simulation water at a flow rate of 5 mL/min, saturating the rock core with the simulation water, and then weighing again, and calculating the porosity;

Step 2: after the rock core is saturated with simulation water, using the simulation oil to displace 20 PV at 5 mL/min, and then to displace 10 PV at 10 mL/min, and then reading the oil volume at saturation, and calculating the oil saturation;

Step 3: using a polymer to prepare a polymer solution according to oil and gas industry standard SY/T 6576-2003;

Step 4: introducing a base solution into an intermediate container, and then filling with pure supercritical carbon dioxide (viscosity: 0.014 mPa·s) and fully dissolving it to prepare a thickened supercritical carbon dioxide oil displacement agent; and Step 5: after the rock core is saturated with the simulation oil, maintaining the confining pressure of 12 MPa, using the simulation water for displacement at a rate of 0.5 mL/min, and after the water cut reaches 90%, adopting the oil displacement method of the present disclosure to displace the oil. During this process, the pressure, water output, and oil output are read every 2 minutes.

Example 11

A hydrophobic associated polymer (mass percentage content of 1 wt %) as polymer, which is partially hydrolyzed polyacrylamide (HPAM) with an average molecular weight of 16 million and a solid content of more than 88% and which is produced by Daqing Refining and Chemical Branch of PetroChina Company Limited, alkyl glycoside (APG, mass percentage content of 0.1 wt %) as surfactant, and sodium hydroxide (mass percentage content of 1.2 wt %) were used to prepare a polymer solution with a solution viscosity of 9.5 mPa·s;

polydimethylsiloxane (average molecular weight of 25000, mass percentage content of 3 wt %) as thickening agent, and kerosene (mass percentage content of 2 wt %) as cosolvent were used to thicken pure supercritical carbon dioxide by 20 times to obtain a supercritical carbon dioxide oil displacement agent with a viscosity of 0.28 mPa·s; and at an injection pressure of 10 MPa, 0.4 PV of the polymer solution and 0.4 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this example is 86.03%.

Example 12

Xanthan gum (average molecular weight of 16 million, mass percentage content of 1 wt %) as polymer, alkyl glycoside (APG, mass percentage content of 0.1 wt %) as surfactant, and sodium hydroxide (mass percentage content of 1.2 wt %) as base were used to prepare a polymer solution with a solution viscosity of 7.2 mPa·s;

polydimethylsiloxane (average molecular weight of 25000, mass percentage content of 3 wt %) as thickening agent, and kerosene (mass percentage content of 0.2 wt %) as cosolvent were used to thicken pure supercritical carbon dioxide by 5 times to obtain a supercritical carbon dioxide oil displacement agent with a viscosity of 0.07 mPa·s;

at an injection pressure of 10 MPa, 0.4 PV of the polymer solution and 0.4 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this example is 73.12%.

Example 13

Star polymer SD-6800 (mass percentage content of 1 wt %) as polymer, which has solid content of 89.7%, average molecular weight of 16 million and degree of hydrolysis of 22.7% and which is provided by Zhangjiakou Shengda of Polymer Co., LTD, alkyl glycoside (APG, mass percentage content of 0.1 wt %) as surfactant, and sodium hydroxide (mass percentage content of 1.2 wt %) as base were used to prepare a polymer solution with a solution viscosity of 8.2 mPa·s;

polydimethylsiloxane (average molecular weight of 25000, mass percentage content of 3 wt %) as thickening agent, and kerosene (mass percentage content of 6 wt %) as cosolvent were used to thicken pure supercritical carbon dioxide by 50 times to obtain a supercritical carbon dioxide oil displacement agent with a viscosity of 0.7 mPa·s;

at an injection pressure of 10 MPa, 0.4 PV of the polymer solution and 0.4 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this example is 88.05%.

Example 14

A hydrophobic associated polymer (mass percentage content of 1 wt %) as polymer, which is partially hydrolyzed polyacrylamide (HPAM) with an average molecular weight of 16 million and a solid content of more than 88% and which is produced by Daqing Refining and Chemical Branch of PetroChina Company Limited, alkyl glycoside (APG, mass percentage content of 0.1 wt %) as surfactant and sodium hydroxide (mass percentage content of 1.2 wt %) were used to prepare a polymer solution with a solution viscosity of 9.5 mPa·s;

vinyl polysiloxane (average molecular weight of 25000, mass percentage content is 3 wt %) as thickening agent, and kerosene (mass percentage content of 2.5 wt %) as cosolvent were used to thicken pure supercritical carbon dioxide by 24 times to obtain a supercritical carbon dioxide oil displacement agent with a viscosity of 0.336 mPa·s;

at an injection pressure of 10 MPa, 0.4 PV of the polymer solution and 0.4 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this example is 90.38%.

Example 15

A hydrophobic associated polymer (mass percentage content of 1 wt %) as polymer, which is partially hydrolyzed polyacrylamide (HPAM) with an average molecular weight of 16 million and a solid content of more than 88% and which is produced by Daqing Refining and Chemical Branch of PetroChina Company Limited, alkyl glycoside (APG, mass percentage content of 0.1 wt %) as surfactant, and sodium hydroxide (mass percentage content of 1.2 wt %) were used to prepare a polymer solution with a solution viscosity of 9.5 mPa·s;

polydimethylsiloxane (average molecular weight of 25000, mass percentage content of 0.05 wt %) as thickening agent, and kerosene (mass percentage content of 2 wt %) as cosolvent were used to thicken pure supercritical carbon dioxide by 2.5 times to obtain a supercritical carbon dioxide oil displacement agent with a viscosity of 0.035 mPa·s;

at an injection pressure of 10 MPa, 0.4 PV of the polymer solution and 0.4 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this example is 72.01%.

Example 16

A hydrophobic associated polymer (mass percentage content of 1 wt %) as polymer, which is partially hydrolyzed polyacrylamide (HPAM) with an average molecular weight of 16 million and a solid content of more than 88% and which is produced by Daqing Refining and Chemical Branch of PetroChina Company Limited, alkyl glycoside (APG, mass percentage content of 0.1 wt %) as surfactant, and sodium hydroxide (mass percentage content of 1.2 wt %) were used to prepare a polymer solution with a solution viscosity of 9.5 mPa·s;

polydimethylsiloxane (average molecular weight of 25000, mass percentage content of 2 wt %) as thickening agent, and kerosene (mass percentage content of 2 wt %) as cosolvent were used to thicken pure supercritical carbon dioxide by 13 times to obtain a supercritical carbon dioxide oil displacement agent with a viscosity of 0.182 mPa·s;

at an injection pressure of 10 MPa, 0.4 PV of the polymer solution and 0.4 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this example is 81.23%.

Example 17

A hydrophobic associated polymer (mass percentage content of 1 wt %) as polymer, which is partially hydrolyzed polyacrylamide (HPAM) with an average molecular weight of 16 million and a solid content of more than 88% and which is produced by Daqing Refining and Chemical Branch of PetroChina Company Limited, and alkyl glycoside (APG, mass percentage content of 0.1 wt %) as surfactant, and sodium hydroxide (mass percentage content of 1.2 wt %) were used to prepare a polymer solution with a solution viscosity of 9.5 mPa·s;

polydimethylsiloxane (average molecular weight of 25000, mass percentage content of 3 wt %) as thickening agent, and kerosene (mass percentage content of 2 wt %) as cosolvent were used to thicken pure supercritical carbon dioxide by 20 times to obtain a supercritical carbon dioxide oil displacement agent with a viscosity of 0.28 mPa·s;

at an injection pressure of 10 MPa, 0.8 PV of the polymer solution and 0.4 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this example is 89.80%.

Example 18

A hydrophobic associated polymer (mass percentage content of 1 wt %) as polymer, which is partially hydrolyzed polyacrylamide (HPAM) with an average molecular weight of 16 million and a solid content of more than 88% and which is produced by Daqing Refining and Chemical Branch of PetroChina Company Limited, alkyl glycoside (APG, mass percentage content of 0.1 wt %) as surfactant, and sodium hydroxide (mass percentage content of 1.2 wt %) were used to prepare a polymer solution with a solution viscosity of 9.5 mPa·s;

polydimethylsiloxane (average molecular weight of 25000, mass percentage content of 3 wt %) as thickening agent, and kerosene (mass percentage content of 2 wt %) as cosolvent were used to thicken pure supercritical carbon dioxide by 20 times to obtain a supercritical carbon dioxide oil displacement agent with a viscosity of 0.28 mPa·s;

at an injection pressure of 10 MPa, 0.4 PV of the polymer solution and 0.8 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this example is 90.08%.

Example 19

A hydrophobic associated polymer (mass percentage content of 1 wt %) as polymer, which is partially hydrolyzed polyacrylamide (HPAM) with an average molecular weight of 3 million and a solid content of more than 88% and which is produced by Daqing Refining and Chemical Branch of PetroChina Company Limited, alkyl glycoside (mass percentage content of 0.1 wt %) as surfactant, and sodium hydroxide (mass percentage content of 1.2 wt %) were used to prepare a polymer solution with a solution viscosity of 2.5 mPa·s;

polydimethylsiloxane (average molecular weight of 25000, mass percentage content of 3 wt %) as thickening agent, and kerosene (mass percentage content of 2 wt %) as cosolvent were used to thicken pure supercritical carbon dioxide by 20 times to obtain a supercritical carbon dioxide oil displacement agent with a viscosity of 0.28 mPa·s;

at an injection pressure of 10 MPa, 0.4 PV of the polymer solution and 0.4 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this example is 77.43%.

Example 20

A hydrophobic associated polymer (mass percentage content of 1 wt %) as polymer, which is partially hydrolyzed polyacrylamide (HPAM) with an average molecular weight of 20 million and a solid content of more than 88% and which is produced by Daqing Refining and Chemical Branch of PetroChina Company Limited, alkyl glycoside (mass percentage content of 0.1 wt %) as surfactant, and sodium hydroxide (mass percentage content of 1.2 wt %) were used to prepare a polymer solution with a solution viscosity of 14 mPa·s;

polydimethylsiloxane (average molecular weight of 25000, mass percentage content of 3 wt %) as thickening agent, and kerosene (mass percentage content of 2 wt %) as cosolvent were used to thicken pure supercritical carbon dioxide by 20 times to obtain a supercritical carbon dioxide oil displacement agent with a viscosity of 0.28 mPa·s;

at an injection pressure of 10 MPa, 0.4 PV of the polymer solution and 0.4 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this example is 85.36%.

Example 21

A hydrophobic associated polymer (mass percentage content of 1 wt %) as polymer, which is partially hydrolyzed polyacrylamide (HPAM) with an average molecular weight of 2 million and a solid content of more than 88% and which is produced by Daqing Refining and Chemical Branch of PetroChina Company Limited, alkyl glycoside (mass percentage content of 0.1 wt %) as surfactant, and sodium hydroxide (mass percentage content of 1.2 wt %) were used to prepare a polymer solution with a solution viscosity of 1.2 mPa·s;

polydimethylsiloxane (average molecular weight of 25000, mass percentage content of 3 wt %) as thickening agent, and kerosene (mass percentage content of 2 wt %) as cosolvent were used to thicken pure supercritical carbon dioxide by 20 times to obtain a supercritical carbon dioxide oil displacement agent with a viscosity of 0.28 mPa·s;

at an injection pressure of 10 MPa, 0.4 PV of the polymer solution and 0.4 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this example is 72.22%.

Example 22

A hydrophobic associated polymer (mass percentage content of 1 wt %) as polymer, which is partially hydrolyzed polyacrylamide (HPAM) with an average molecular weight of 24 million and a solid content of more than 88% and which is produced by Daqing Refining and Chemical Branch of PetroChina Company Limited, alkyl glycoside (mass percentage content of 0.1 wt %) as surfactant, and sodium hydroxide (mass percentage content of 1.2 wt %) were used to prepare a polymer solution with a solution viscosity of 15 mPa·s;

polydimethylsiloxane (average molecular weight of 25000, mass percentage content of 3 wt %) as thickening agent, and kerosene (mass percentage content of 2 wt %) as cosolvent were used to thicken pure supercritical carbon dioxide by 20 times to obtain a supercritical carbon dioxide oil displacement agent with a viscosity of 0.28 mPa·s;

at an injection pressure of 10 MPa, 0.4 PV of the polymer solution and 0.4 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this example is 83.14%.

Comparative Example 14

Xanthan gum (average molecular weight of 16 million, mass percentage content of 0.1 wt %) as polymer, alkyl glycoside (APC, mass percentage content of 0.1 wt %) as surfactant, and sodium hydroxide (mass percentage content of 1.2 wt %) as base were used to prepare a polymer solution with a solution viscosity of 0.8 mPa·s;

polydimethylsiloxane (average molecular weight of 25000, mass percentage content of 3 wt %) as thickening agent, and kerosene (mass percentage content of 2 wt %) as cosolvent were used to thicken pure supercritical carbon dioxide by 20 times to obtain a supercritical carbon dioxide oil displacement agent with a viscosity of 0.28 mPa·s;

at an injection pressure of 10 MPa, 0.4 PV of the polymer solution and 0.4 PV of the supercritical carbon dioxide oil displacement agent were injected in sequence into the above rock core with a water cut of 90%, and then water flooding was performed, and when the water cut reached 98%, the oil recovery of crude oil was recorded, and the oil recovery of crude oil in this comparative example is 69.15%.

Figure 17:
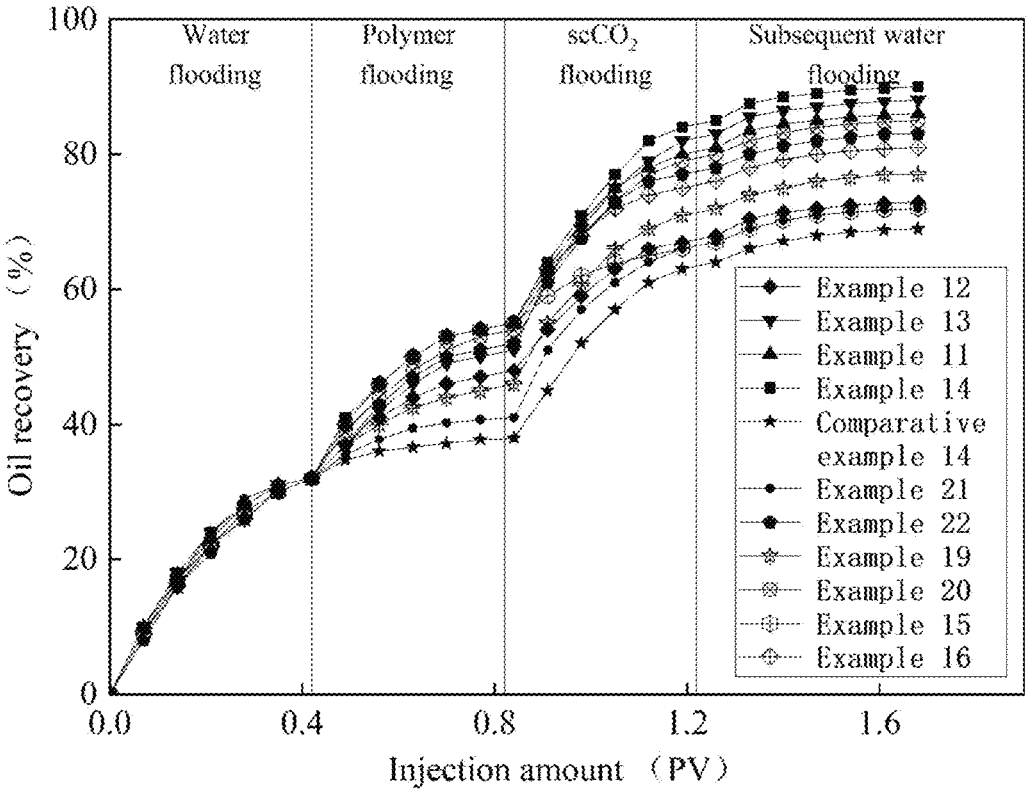
FIG. 17 is a trend diagram of an oil recovery with injection amount in Example 11 to Example 16, Example 19 to Example 22, and Comparative Example 14 of the present disclosure.
Figure 18:
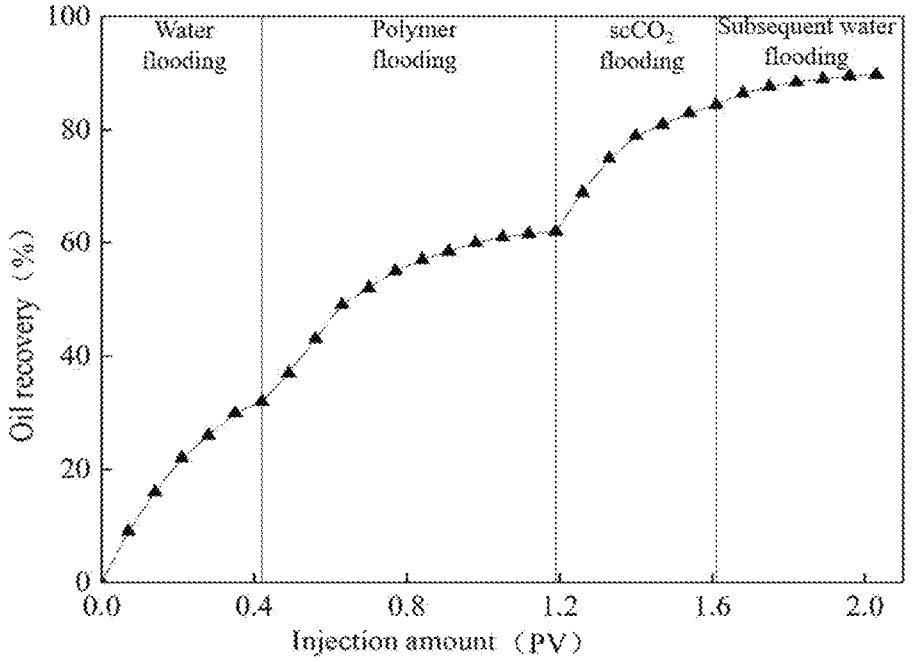
FIG. 18 is a trend diagram of an oil recovery with injection amount in Example 17 of the present disclosure.
Figure 19:
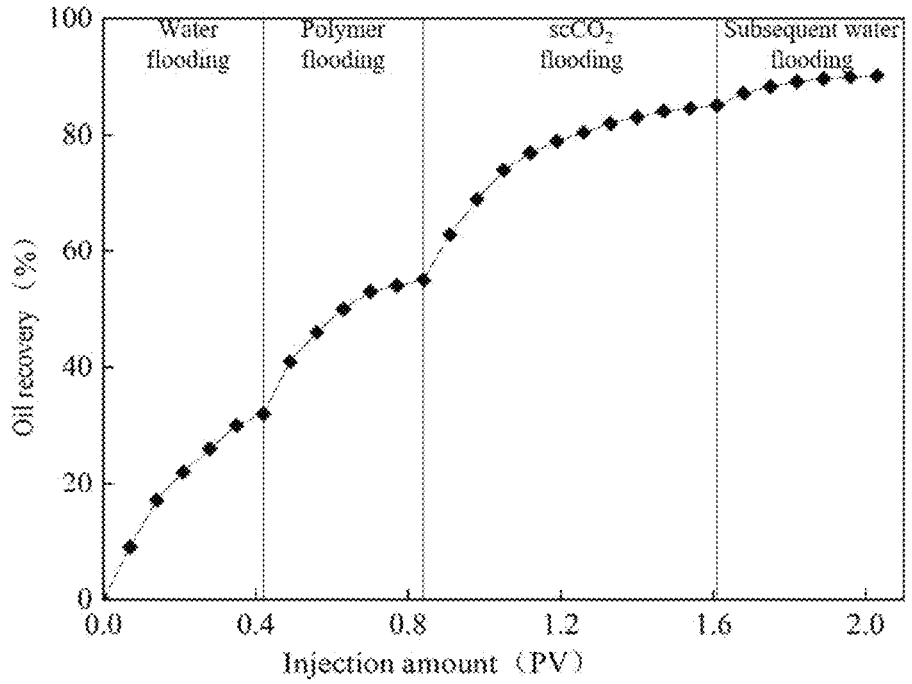
FIG. 19 is a trend diagram of an oil recovery with injection amount in Example 18 of the present disclosure.

Specific data is shown in Table 4 and FIGS. 17-19.

TABLE 4

| | Viscosity of polymer solution mPa · s | Viscosity of supercritical carbon dioxide oil displacement agent mPa · s | Viscosity ratio of polymer solution to crude oil | Viscosity ratio of supercritical carbon dioxide oil displacement agent to crude oil | Injection amount of polymer solution PV | Injection amount of supercritical carbon dioxide oil displacement agent PV | The oil recovery of crude oil % |
|---|---|---|---|---|---|---|---|
| Example 11 | 9.5 | 0.28 | 1:1.26 | 1:43 | 0.4 | 0.4 | 86.03 |
| Example 12 | 7.2 | 0.07 | 1:1.67 | 1:171 | 0.4 | 0.4 | 73.12 |
| Example 13 | 8.2 | 0.7 | 1:1.46 | 1:17 | 0.4 | 0.4 | 88.05 |
| Example 14 | 9.5 | 0.336 | 1:1.26 | 1:36 | 0.4 | 0.4 | 90.38 |
| Example 15 | 9.5 | 0.035 | 1:1.26 | 1:343 | 0.4 | 0.4 | 72.01 |
| Example 16 | 9.5 | 0.182 | 1:1.26 | 1:66 | 0.4 | 0.4 | 81.23 |
| Example 17 | 9.5 | 0.28 | 1:1.26 | 1:43 | 0.8 | 0.4 | 89.80 |
| Example 18 | 9.5 | 0.28 | 1:1.26 | 1:43 | 0.4 | 0.8 | 90.08 |
| Example 19 | 2.5 | 0.28 | 1:4.8 | 1:43 | 0.4 | 0.4 | 77.43 |
| Example 20 | 14 | 0.28 | 1:0.86 | 1:43 | 0.4 | 0.4 | 85.36 |
| Example 21 | 1.2 | 0.28 | 1:10 | 1:43 | 0.4 | 0.4 | 72.22 |
| Example 22 | 15 | 0.28 | 1:0.8 | 1:43 | 0.4 | 0.4 | 83.14 |
| Comparative Example 14 | 0.8 | 0.28 | 1:15 | 1:43 | 0.4 | 0.4 | 69.15 |

It can be seen from Tables 3 and 4:

Examples 11 to 22 each used different polymers and thickening agents, to displace ultra-high water-cut reservoirs at different viscosities, and all achieved high the oil recovery, up to 90.38%; while the oil recovery of Comparative Example 14 was only 69.15%. Where, although Examples 17 and 18 had higher the oil recovery than Example 11, but they had increased cost accordingly, and lowered economic benefits. It can be seen from the above that the oil displacement method of the present disclosure can achieve high the oil recovery for ultra-high water-cut reservoirs.

FIGS. 17, 18, and 19 are trend diagrams of the oil recovery with injection amounts in Examples and Comparative Examples, respectively.

Finally, it should be stated that the above examples are only used to illustrate the technical solutions of the present disclosure, rather than limit them; although the present disclosure has been described in detail with reference to the foregoing examples, those of ordinary skill in the art should understand that the technical solutions described in the foregoing examples can still be modified, or some or all of the technical features therein can be equivalently replaced; and these modifications or replacements do not make the essence of corresponding technical solutions deviate from the scope of the technical solutions of the examples of the present disclosure.

What is claimed is:

1. An oil displacement method for an ultra-high water-cut reservoir having a water cut greater than 90%, comprising the following steps:

(1) injecting water into the reservoir to carry out a water flooding until water cut of the reservoir is greater than 90%;

(2) injecting a polymer solution and a supercritical carbon dioxide oil displacement agent, respectively;

(3) injecting water to carry out water flooding, after injection of the polymer solution or the supercritical carbon dioxide oil displacement agent is completed;

wherein injection amounts of both the polymer solution and the supercritical carbon dioxide oil displacement agent are not less than 0.1 PV, and a total injection amount of the polymer solution and the supercritical carbon dioxide oil displacement agent is 0.3-1.2 PV; and a viscosity ratio of the polymer solution to crude oil in the reservoir is 1:(0.8-10), and a viscosity ratio of the supercritical carbon dioxide oil displacement agent to the crude oil in the reservoir is 1:(10-800).

2. The oil displacement method for an ultra-high water-cut reservoir according to claim 1, wherein a viscosity of the polymer solution is not less than 1 mPa·s;

and/or, a viscosity of the supercritical carbon dioxide oil displacement agent is greater than a viscosity of pure supercritical carbon dioxide and less than a viscosity of the crude oil in the reservoir.

3. The oil displacement method for an ultra-high water-cut reservoir according to claim 2, wherein the injection amount of the polymer solution is 0.1-0.6PV, and/or the injection amount of the supercritical carbon dioxide oil displacement agent is 0.1-0.6PV.

4. The oil displacement method for an ultra-high water-cut reservoir according to claim 3, wherein step (2) is performed in multiple cycles;

the injection amount of the polymer solution is 0.05-0.2PV, and the injection amount of the supercritical carbon dioxide oil displacement agent is 0.05-0.2PV.

5. The oil displacement method for an ultra-high water-cut reservoir according to claim 2, wherein step (2) is performed in multiple cycles;

the injection amount of the polymer solution is 0.05-0.2PV, and the injection amount of the supercritical carbon dioxide oil displacement agent is 0.05-0.2PV.

6. The oil displacement method for an ultra-high water-cut reservoir according to claim 2, wherein an internal pressure of the reservoir is less than a miscible pressure of the supercritical carbon dioxide oil displacement agent and the crude oil.

7. The oil displacement method for an ultra-high water-cut reservoir according to claim 2, wherein the polymer solution comprises a polymer and water; and the polymer comprises at least one of xanthan gum, crosslinked polymer, hydrophobic associated polymer, comb polymer, and star polymer.

8. The oil displacement method for an ultra-high water-cut reservoir according to claim 2, wherein the polymer solution further comprises a surfactant and a basic compound;

the surfactant comprises at least one of non-ionic surfactant, anionic surfactant and zwitterionic surfactant; and the basic compound comprises at least one of sodium hydroxide, sodium carbonate, sodium bicarbonate, and ammonium hydroxide.

9. The oil displacement method for an ultra-high water-cut reservoir according to claim 8, wherein an average molecular weight of the polymer is 3 million to 21 million.

10. The oil displacement method for an ultra-high water-cut reservoir according to claim 2, wherein the supercritical carbon dioxide oil displacement agent comprises supercritical carbon dioxide and a base solution dissolved in the supercritical carbon dioxide, and the base solution comprises a thickening agent, a cosolvent and water;

in the base solution, a mass percentage content of the thickening agent is 0.05-3 wt %, a mass percentage content of the cosolvent is 0.05-6 wt %, and a balance is water; and the cosolvent comprises at least one of kerosene, ether, and n-decane.

11. The oil displacement method for an ultra-high water-cut reservoir according to claim 10, wherein the thickening agent comprises at least one of siloxane-based thickening agent and hydrocarbon-based thickening agent;

the siloxane-based thickening agent comprises at least one of a compound represented by Formula 1, a compound represented by Formula 2, and a compound represented by Formula 3, Formula 1

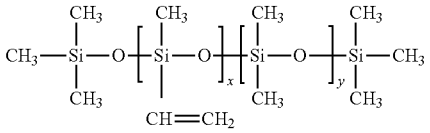

Formula 2

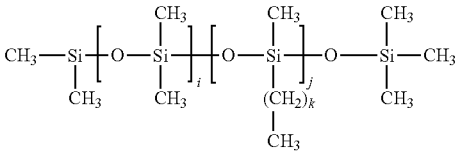

Formula 3

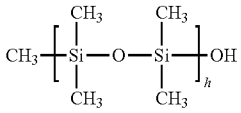

in Formula 1, x and y are each independently selected from a positive integer; in Formula 2, i, j, and k are each independently selected from a positive integer; and in Formula 3, h is selected from a positive integer; and the hydrocarbon-based thickening agent comprises at least one of a compound represented by Formula 4, a compound represented by Formula 5, and a compound represented by Formula 6, Formula 4

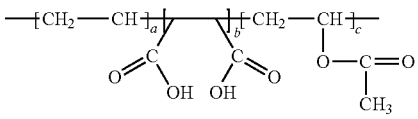

Formula 5

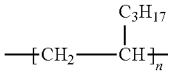

Formula 6

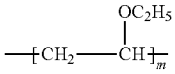

in Formula 4, a, b, and c are each independently selected from a positive integer; in Formula 5, n is selected from a positive integer; and in Formula 6, m is selected from a positive integer.

12. The oil displacement method for an ultra-high water-cut reservoir according to claim 1, wherein the injection amount of the polymer solution is 0.1-0.6PV, and/or the injection amount of the supercritical carbon dioxide oil displacement agent is 0.1-0.6PV.

13. The oil displacement method for an ultra-high water-cut reservoir according to claim 12, wherein step (2) is performed in multiple cycles, the injection amount of the polymer solution is 0.05-0.2PV, and the injection amount of the supercritical carbon dioxide oil displacement agent is 0.05-0.2PV.

14. The oil displacement method for an ultra-high water-cut reservoir according to claim 1, wherein step (2) is performed in multiple cycles;

the injection amount of the polymer solution is 0.05-0.2PV, and the injection amount of the supercritical carbon dioxide oil displacement agent is 0.05-0.2PV.

15. The oil displacement method for an ultra-high water-cut reservoir according to claim 1, wherein an internal pressure of the reservoir is less than a miscible pressure of the supercritical carbon dioxide oil displacement agent and the crude oil.

16. The oil displacement method for an ultra-high water-cut reservoir according to claim 1, wherein the polymer solution comprises a polymer and water, and the polymer comprises at least one of xanthan gum, crosslinked polymer, hydrophobic associated polymer, comb polymer, and star polymer.

17. The oil displacement method for an ultra-high water-cut reservoir according to claim 1, wherein the polymer solution further comprises a surfactant and a basic compound;

the surfactant comprises at least one of non-ionic surfactant, anionic surfactant and zwitterionic surfactant; and the basic compound comprises at least one of sodium hydroxide, sodium carbonate, sodium bicarbonate, and ammonium hydroxide.

18. The oil displacement method for an ultra-high water-cut reservoir according to claim 17, wherein an average molecular weight of the polymer is 3 million to 21 million.

19. The oil displacement method for an ultra-high water-cut reservoir according to claim 1, wherein the supercritical carbon dioxide oil displacement agent comprises supercritical carbon dioxide and a base solution dissolved in the supercritical carbon dioxide, and the base solution comprises a thickening agent, a cosolvent and water;

in the base solution, a mass percentage content of the thickening agent is 0.05-3 wt %, a mass percentage content of the cosolvent is 0.05-6 wt %, and a balance is water; and the cosolvent comprises at least one of kerosene, ether, and n-decane.

20. The oil displacement method for an ultra-high water-cut reservoir according to claim 19, wherein the thickening agent comprises at least one of siloxane-based thickening agent and hydrocarbon-based thickening agent;

the siloxane-based thickening agent comprises at least one of a compound represented by Formula 1, a compound represented by Formula 2, and a compound represented by Formula 3, Formula 1

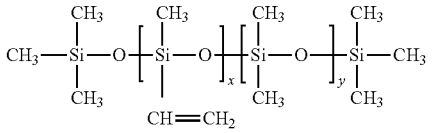

-continued

Formula 2

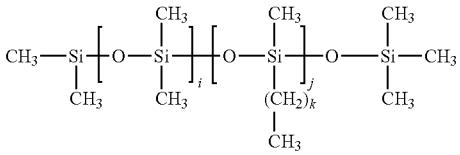

Formula 3

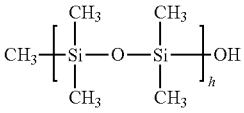

in Formula 1, x and y are each independently selected from a positive integer; in Formula 2, i, j, and k are each independently selected from a positive integer; and in Formula 3, h is selected from a positive integer; and the hydrocarbon-based thickening agent comprises at least one of a compound represented by Formula 4, a compound represented by Formula 5, and a compound represented by Formula 6, Formula 4

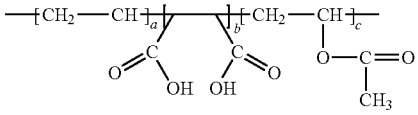

Formula 5

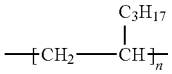

Formula 6

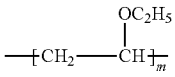

in Formula 4, a, b, and c are each independently selected from a positive integer; in Formula 5, n is selected from a positive integer; and in Formula 6, m is selected from a positive integer.

* * * * *